US007058336B2

(12) United States Patent
Murakami et al.

(10) Patent No.: US 7,058,336 B2
(45) Date of Patent: Jun. 6, 2006

(54) ACCESS-CONTROLLING MECHANISM AND IMAGE FORMING APPARATUS

(75) Inventors: Susumu Murakami, Soraku-gun (JP); Minoru Tomiyori, Soraku-gun (JP); Yoshie Iwakura, Higashiosaka (JP); Hideshi Izumi, Ikoma (JP); Takashi Hori, Yao (JP); Takateru Yamamoto, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 203 days.

(21) Appl. No.: 10/777,914

(22) Filed: Feb. 11, 2004

(65) Prior Publication Data

US 2004/0161259 A1 Aug. 19, 2004

(30) Foreign Application Priority Data

Feb. 13, 2003 (JP) ..... 2003-035307
May 9, 2003 (JP) ..... 2003-132049

(51) Int. Cl.
*G03G 15/00* (2006.01)
*G03G 21/00* (2006.01)

(52) U.S. Cl. ..... 399/110; 399/124

(58) Field of Classification Search ..... 399/110, 399/107, 124, 125, 121, 122, 116, 118, 115
See application file for complete search history.

(56) References Cited

U.S. PATENT DOCUMENTS 5,168,308 A * 12/1992 Hiraike et al. ..... 399/125
5,280,331 A * 1/1994 Namiki ..... 399/124
5,579,098 A * 11/1996 Noguchi et al. ..... 399/122
5,722,013 A * 2/1998 Nagase et al. ..... 399/118 X
6,947,687 B1 * 9/2005 Yamaguchi et al. ..... 399/111
2005/0047821 A1 * 3/2005 Murayama et al. ..... 399/111

FOREIGN PATENT DOCUMENTS

| | | |
|---|---|---|
| JP | 62-255324 | 11/1987 |
| JP | 62-260165 A * | 11/1987 |
| JP | 8-18724 | 1/1996 |
| JP | 2002-274693 | 9/2002 |
| JP | 2003-241615 | 8/2003 |

* cited by examiner

*Primary Examiner*—Sophia S. Chen
(74) *Attorney, Agent, or Firm*—David G. Conlin; David A. Tucker; Edwards Angell Palmer & Dodge LLP

(57) ABSTRACT

When handle region(s) of disengaging lever(s) is/are pulled in direction(s) tending to cause disengagement of engagement between access-controlling body or bodies and main body housing(s), respective action edge(s) of rotating region (s) may rotate about shaft(s) in direction(s) tending to cause disengagement of engagement. Upon rotating in direction(s) tending to cause disengagement of engagement, respective action edge(s) of rotating region(s) may press on and impel support plate(s) of main body housing(s). In accompaniment thereto, disengaging lever(s) may move upward, and respective downwardly directed engagement projection(s) of access-controlling body or bodies may be lifted up and extricated from respective upwardly directed engagement projection(s) of main body housing(s). Moreover, when handle region(s) of disengaging lever(s) is/are pulled, respective sliding frame(s) of access-controlling body or bodies may move along respective guide rail(s) of main body housing(s) and toward exterior(s) of main body housing(s), greatly opening up access at opening(s) of main body housing(s).

20 Claims, 15 Drawing Sheets

ACCESS-CONTROLLING MECHANISM AND IMAGE FORMING APPARATUS

CROSS-REFERENCE TO RELATED APPLICATION/PRIORITY

This Nonprovisional application claims priority under 35 U.S.C. § 119(a) on Patent Application Nos. 2003-035307 filed in Japan on Feb. 13, 2003 and 2003-132049 filed in Japan on May 9, 2003, the entire contents of which are hereby incorporated by reference.

BACKGROUND OF INVENTION

Technical Field

The present invention pertains to an access-controlling mechanism for access-controlling actuation of access-controlling body or bodies, and to an image forming apparatus employing such access-controlling mechanism(s).

In an electrophotographic image forming apparatus, for example, an electrostatic latent image representing an original might be formed on a photosensitive body, the electrostatic latent image on the photosensitive body might be developed through use of toner, the toner image might be transferred from the photosensitive body to recording paper, and the toner image on the recording paper might be fixed.

Examples of this sort of apparatus include copiers, printers, facsimile machines, and so forth. In all such apparatuses, jamming of recording paper being unavoidable, provided at various locations are access-controlling bodies such as will permit removal of recording paper at the interior of the apparatus. Furthermore, access-controlling bodies are also provided for purposes of supplying recording paper, toner, and/or the like to the interior of the apparatus.

For example, at Japanese Patent Application Publication Kokai No. S62-255324 (1987), art is disclosed in which recording paper is stored in stacked fashion in a cassette and the cassette is inserted into a cassette bay on the apparatus main body by sliding it thereinto, positioning of the cassette occurring as a result of meshing engagement of notch(es) in the base of the cassette by projection-like tip(s) at the apparatus main body.

Furthermore, at Japanese Patent Application Publication Kokoku No. H8-18724 (1996), art is disclosed in which a recording paper transport path unit is pivotably supported by an apparatus main unit by means of a horizontal pivot shaft, access being opened up at the transport path unit and the recording paper being removed in the event that a jam occurs.

In addition, at Japanese Patent Application Publication Kokai No. 2002-274693, art is disclosed in which apparatus side wall(s) of an apparatus main body are movably supported by two guide members, opening and closing of an opening in the apparatus main body being accomplished by moving the apparatus side wall(s) in parallel fashion; and when the apparatus side wall(s) is/are closed, locking mechanisms at both of the apparatus side wall sides make it possible for the apparatus side wall(s) to be secured to the apparatus main body.

But with respect to the art described at Japanese Patent Application Publication Kokai No. S62-255324 (1987), while the accuracy with which the cassette can be positioned is good when notch(es) in the base of the cassette is/are meshingly engaged by projection-like tip(s) at the apparatus main body, this has been less than satisfactory with respect to ease of operations, since, during removal of the cassette, it has been necessary to lift the cassette up so as to extricate the notch(es) in the base of the cassette from the projection-like tip(s) at the apparatus main body. Particularly where the cassette is heavy or is at a high location, removal of the cassette has been difficult.

Furthermore, with respect to the art described at Japanese Patent Application Publication Kokoku No. H8-18724 (1996), where the transport path unit is pivotably supported by the apparatus main unit, although this might make for simple operations in connection with opening up and closing off of access at the transport path unit, the degree to which apparatus main body interior access is permitted has been inadequate in the vicinity of the pivot shaft of the transport path unit, reducing ease of maintenance.

Furthermore, with respect to the art described at Japanese Patent Application Publication Kokai No. 2002-274693, where the apparatus side wall(s) are moved in parallel fashion to open and close the opening in the apparatus main body, while adequate access may be permitted by the entire apparatus main body opening, not only has it been necessary to secure the apparatus side wall(s) to the apparatus main body by means of the locking mechanisms at both sides but the locking mechanisms at both sides have also had a tendency to become loose, decreasing the accuracy with which the apparatus side wall(s) can be positioned. Such a locking mechanism will typically have a high parts count and be complicated, and the fact that a load is continuously applied thereto when the apparatus side wall(s) is/are closed has tended to cause distortion and loosening, as a result of which there has been decrease in the accuracy with which the apparatus side wall(s) can be positioned. Moreover, there has been a tendency for an uneven closure phenomenon to occur in which only one of the locking mechanisms at the two sides locks, and this has also contributed to decrease in the accuracy with which the apparatus side wall(s) can be positioned.

The present invention was therefore conceived in light of the foregoing conventional problems, it being an object thereof to provide an access-controlling mechanism and image forming apparatus permitting good ease of operations, permitting adequate access over the entirety or entireties of opening(s), and making it possible for satisfactory accuracy of positioning to be maintained.

SUMMARY OF INVENTION

In order to solve the foregoing and/or other problems, an access-controlling mechanism in accordance with one or more embodiments of the present invention may comprise one or more apparatus main bodies; one or more access-controlling bodies removably deployed at one or more openings of at least one of the apparatus main body or bodies; one or more engaging means causing at least one of the access-controlling body or bodies deployed at at least one of the opening or openings of at least one of the apparatus main body or bodies to engage with at least one of the apparatus main body or bodies; and one or more disengaging means provided at at least one of the access-controlling body or bodies and disengaging engagement produced by at least one of the engaging means; at least one of the disengaging means being such that disengagement of engagement produced by at least one of the engaging means occurs due to the fact that actuation of at least one of the disengaging means causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

In accordance with embodiment(s) of the present invention constituted in such fashion, disengagement of engagement produced by engaging means occurs due to the fact that actuation of disengaging means causes access-controlling body or bodies to move away from engaging means and in direction(s) tending to cause disengagement of engagement produced by engaging means or causes engaging means to move away from access-controlling body or bodies and in direction(s) tending to cause disengagement of engagement produced by engaging means. Accordingly, access-controlling body or bodies may be extricated merely by actuating disengaging means, making for good ease of operations. Furthermore, method(s) in which access-controlling body or bodies is/are moved in parallel fashion may, for example, be employed as method(s) for deploying and/or removing access-controlling body or bodies, permitting adequate access over the entirety or entireties of opening(s) of apparatus main body or bodies. Furthermore, as engaging means, it is possible to employ simple constitutions which do not contained movable member(s) and in which projection(s) engage with projection(s), male portion(s) engage with female portion(s), and/or the like. As a result, it is easy to provide engaging means with adequate strength and it is possible to maintain satisfactory accuracy of positioning of access-controlling body or bodies by engaging means. Furthermore, it is possible to achieve reductions in engaging means design time and cost.

Furthermore, in one or more embodiments of the present invention, at least one of the apparatus main body or bodies may be at least one image forming apparatus main body; at least one of the access-controlling body or bodies being removably deployed at at least one of the opening or openings of at least one of the image forming apparatus main body or bodies.

Application of the present invention to image forming apparatus(es) is extremely effective, because a plurality of access-controlling bodies may be provided at various locations so as to permit removal of recording paper in the event that jamming of recording paper occurs and/or so as to permit supply of recording paper, toner, and/or the like to the interior of the apparatus.

Moreover, in one or more embodiments of the present invention, at least one of the access-controlling body or bodies may be supported by one or more guide members so as to permit movement with respect to at least one of the apparatus main body or bodies.

By thus causing access-controlling body or bodies to be movably supported by guide member(s), it is possible to facilitate deployment and/or removal of access-controlling body or bodies. Furthermore, by moving access-controlling body or bodies in parallel fashion, it is possible to achieve adequate access over the entirety or entireties of opening(s) of apparatus main body or bodies.

Furthermore, in one or more embodiments of the present invention, at least one of the first direction or directions tending to cause disengagement of engagement produced by at least one of the engaging means may be at least one approximately vertically upward direction or at least one approximately vertically downward direction; and at least one of the second direction or directions tending to cause disengagement of engagement produced by at least one of the engaging means may be at least one approximately vertically upward direction or at least one approximately vertically downward direction.

Where this is the case, direction(s) tending to cause disengagement of engagement produced by engaging means will be in more or less the same direction(s) in which gravity acts or will be more or less opposite to direction(s) in which gravity acts.

Moreover, in one or more embodiments of the present invention, at least one of the disengaging means may be at least one disengaging lever comprising one or more actuation regions, one or more pivot regions, and one or more action regions; and disengagement of engagement produced by at least one of the engaging means may occur due to the fact that at least one of the actuation region or regions of at least one of the disengaging lever or levers receives one or more actuation forces, at least one of the action region or regions of at least one of the disengaging lever or levers is displaced, and at least one of the action region or regions of at least one of the disengaging lever or levers causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

In such case, disengaging lever(s) may act as mechanical lever(s). Disengagement of engagement produced by engaging means may occur due to the fact that actuation of actuation region(s) of disengaging lever(s) causes action region(s) of disengaging lever(s) to be displaced. Furthermore, because actuation region(s) of disengaging lever(s) may receive actuation force(s) in direction(s) of deployment and/or removal of access-controlling body or bodies, it is possible for actuation capable of opening up of access at access-controlling body or bodies to commence simultaneous with disengagement of engagement produced by engaging means. This being the case, ease of operations in connection with opening up of access at access-controlling body or bodies may be improved greatly.

Furthermore, in one or more embodiments of the present invention, at least one of the action region or regions of at least one of the disengaging lever or levers may cause at least one of the access-controlling body or bodies to move away from at least one of the engaging means and in one or more first directions tending to cause disengagement of engagement produced by at least one of the engaging means, or may cause at least one of the engaging means to move away from at least one of the access-controlling body or bodies and in one or more second directions tending to cause disengagement of engagement produced by at least one of the engaging means, in at least one vicinity of at least one imaginary vertical line depending from at least one center of gravity of at least one of the access-controlling body or bodies.

By thus causing action region(s) of disengaging lever(s) to be displaced in vicinity or vicinities of imaginary vertical line(s) depending from center(s) of gravity of access-controlling body or bodies, it is possible to impel access-controlling body or bodies in definitive fashion and it is possible to carry out disengagement of engagement produced by engaging means in definitive fashion.

Moreover, in one or more embodiments of the present invention, at least one of the action region or regions of at least one of the disengaging lever or levers may cause at least one of the access-controlling body or bodies to move away from at least one of the engaging means and in one or more first directions tending to cause disengagement of engagement produced by at least one of the engaging means, or may cause at least one of the engaging means to move away from at least one of the access-controlling body or bodies and in one or more second directions tending to cause disengagement of engagement produced by at least one of the engaging means, in at least one vicinity of at least one location where at least one of the access-controlling body or bodies is engaged by at least one of the engaging means.

By thus causing action region(s) of disengaging lever(s) to be displaced in vicinity or vicinities of location(s) where access-controlling body or bodies is/are engaged by engaging means, it is possible to cause such displacement to act on engaging means in definitive fashion and it is possible to carry out disengagement of engagement produced by engaging means in definitive fashion.

Furthermore, one or more embodiments of the present invention may further comprise one or more disengaging-lever restoring-force-imparting means imparting at least one of the actuation region or regions of at least one of the disengaging lever or levers with at least one restoring force opposite in direction to at least one actuation direction.

By thus causing actuation region(s) of disengaging lever(s) to be imparted with restoring force(s) opposite in direction to actuation direction(s), it is possible at time(s) when disengaging lever(s) is/are not being actuated to cause disengaging lever(s) to be pressed against location(s) peripheral thereto and to positively locate disengaging lever(s), preventing disengaging lever(s) from obstructing surrounding member(s). Furthermore, ease of operations is improved, there being no need to return disengaging lever(s) to its/their initial position(s) following actuation of disengaging lever (s).

Moreover, in one or more embodiments of the present invention, at least one location where engagement by at least one of the engaging means occurs and at least one direction of at least one of the action region or regions of at least one of the disengaging lever or levers differ in at least one direction perpendicular to at least one direction of deployment and/or removal of at least one of the access-controlling body or bodies.

Here, it is possible to cause location(s) where engagement by engaging means occurs and location(s) of action region (s) of disengaging lever(s) to be made to coincide and/or be brought close to each otherin direction(s) of deployment and/or removal of access-controlling body or bodies, permitting reduction in size of the apparatus and so forth.

Furthermore, in one or more embodiments of the present invention, at least one of the action region or regions of at least one of the disengaging lever or levers is in at least one vicinity of at least one pivot region of at least one of the disengaging lever or levers. Alternatively or in addition thereto, at least one of the action region or regions of at least one of the disengaging lever or levers may be in at least one location distant from at least one pivot region of at least one of the disengaging lever or levers.

By thus setting positional relationship(s) between pivot region(s) and action region(s) of disengaging lever(s), it is possible to appropriately set actuation force(s) and/or actuation stroke(s) of actuation region(s) of disengaging lever(s).

Furthermore, in one or more embodiments of the present invention, at least one of the action region or regions of at least one of the disengaging lever or levers is provided with one or more rotatable rollers. Such roller(s) may, for example, be at least partially cylindrical and/or spherical in shape.

By thus providing action region(s) of disengaging lever(s) with rotatable roller(s), it is possible to reduce friction between action region(s) and portion(s) coming in contact with such action region(s) during displacement of action region(s) of disengaging lever(s), reducing actuation force (s) at actuation region(s) of disengaging lever(s) and improving ease of operation of disengaging lever(s).

Furthermore, if rolling of roller(s) at action region(s) of disengaging lever(s) is maintained when disengaging lever (s) is/are actuated during closing off of access at access-controlling body or bodies, this will make it possible to cause engagement produced by engaging means to be established in smooth fashion, to quickly deploy access-controlling body or bodies at opening(s) of apparatus main body or bodies, to achieve reduction in impact occurring at time(s) of deployment, and to improve accuracy of positioning of access-controlling body or bodies relative to opening(s) in apparatus main body or bodies.

Furthermore, in one or more embodiments of the present invention, at least one diameter of at least one of the roller or rollers is approximately equal to or is slightly greater than at least one height of at least one of the engaging means.

This is predicated upon the condition that roller(s) at action region(s) of disengaging lever(s) be able to surmount engaging means during opening up of access at access-controlling body or bodies. In such a case, if diameter(s) of roller(s) is/are approximately equal to or is/are slightly greater than height(s) of engaging means, it will be possible for roller(s) to easily surmount engaging means and/or it will be possible for sensation(s) of resistance arising when engaging means is/are surmounted by roller(s) to be transmitted via disengaging lever(s) to person(s) performing actuation, making for good ease of operations. If diameter(s) of roller(s) were to be made too small relative to height(s) of engaging means then it would be difficult for roller(s) to surmount engaging means; conversely, if diameter(s) of roller(s) were to be made too large relative to height(s) of engaging means then sensation(s) of resistance arising when engaging means is/are surmounted by roller(s) would no longer be transmitted via disengaging lever(s) to person(s) performing actuation.

Moreover, in one or more embodiments of the present invention, at least one of the disengaging means is such that at least one of the access-controlling body or bodies is displaced away from at least one of the apparatus main body or bodies simultaneously with respect to disengagement of engagement produced by at least one of the engaging means occurring due to the fact that actuation of at least one of the disengaging means causes at least one of the access-controlling body or bodies to move away from at least one of the engaging means and in one or more first directions tending to cause disengagement of engagement produced by at least one of the engaging means.

By thus causing access-controlling body or bodies to move away from apparatus main body or bodies simultaneously with respect to disengagement of engagement produced by engaging means, it is possible during opening up of access at access-controlling body or bodies to achieve this without any need for access-controlling body or bodies to come in contact with member(s) at interior(s) of apparatus main body or bodies. For example, in image forming apparatus(es), because photosensitive drum(s) and other such high-precision component(s) are disposed therein, it is desirable that access-controlling body or bodies not come in contact with member(s) at interior(s) of apparatus main body or bodies during opening up of access at access-controlling body or bodies.

Furthermore, one or more embodiments of the present invention may further comprise one or more access-controlling-body restoring-force-imparting means imparting at least one of the access-controlling body or bodies with at least one restoring force in at least one deployment direction or in at least one removal direction.

By thus imparting access-controlling body or bodies with restoring force(s) in deployment direction(s) or in removal direction(s), it is possible to eliminate backlash in access-controlling body or bodies when in its/their deployed state (s), improving the accuracy with which access-controlling body or bodies can be positioned.

Moreover, in one or more embodiments of the present invention, at least one of the engaging means has at least one stepped surface for stopping at least one of the access-controlling body or bodies in at least one direction of deployment and/or removal of at least one of the access-controlling body or bodies; and at least one sloped surface for surmounting at least one of the stepped surface or surfaces.

Where such stepped surface(s) and sloped surface(s) are provided, access-controlling body or bodies surmount sloped surface(s) to engage with stepped surface(s). This being the case, it is possible to simplify operation in connection with closing off of access at access-controlling body or bodies.

Next, an access-controlling mechanism in accordance with one or more embodiments of the present invention may comprise one or more apparatus main bodies; one or more access-controlling bodies removably deployed at one or more openings of at least one of the apparatus main body or bodies; one or more engaging means causing at least one of the access-controlling body or bodies deployed at at least one of the opening or openings of at least one of the apparatus main body or bodies to engage with at least one of the apparatus main body or bodies; and one or more disengaging levers provided at at least one of the access-controlling body or bodies and disengaging engagement produced by at least one of the engaging means; wherein at least one of the disengaging lever or levers comprises one or more actuation regions, one or more pivot regions, and one or more action regions and is such that disengagement of engagement produced by at least one of the engaging means occurs due to the fact that at least one of the actuation region or regions of at least one of the disengaging lever or levers receives one or more actuation forces, at least one of the action region or regions of at least one of the disengaging lever or levers is displaced, and at least one of the action region or regions of at least one of the disengaging lever or levers causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

Furthermore, an image forming apparatus in accordance with one or more embodiments of the present invention may comprise one or more image forming apparatus main bodies; one or more access-controlling bodies removably deployed at one or more openings of at least one of the image forming apparatus main body or bodies; one or more engaging means causing at least one of the access-controlling body or bodies deployed at at least one of the opening or openings of at least one of the image forming apparatus main body or bodies to engage with at least one of the image forming apparatus main body or bodies; and one or more disengaging means provided at at least one of the access-controlling body or bodies and disengaging engagement produced by at least one of the engaging means; at least one of the disengaging means being such that disengagement of engagement produced by at least one of the engaging means occurs due to the fact that actuation of at least one of the disengaging means causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

Moreover, an image forming apparatus in accordance with one or more embodiments of the present invention may comprise one or more image forming apparatus main bodies; one or more access-controlling bodies removably deployed at one or more openings of at least one of the image forming apparatus main body or bodies; one or more engaging means causing at least one of the access-controlling body or bodies deployed at at least one of the opening or openings of at least one of the image forming apparatus main body or bodies to engage with at least one of the image forming apparatus main body or bodies; and one or more disengaging levers provided at at least one of the access-controlling body or bodies and disengaging engagement produced by at least one of the engaging means; wherein at least one of the disengaging lever or levers comprises one or more actuation regions, one or more pivot regions, and one or more action regions and is such that disengagement of engagement produced by at least one of the engaging means occurs due to the fact that at least one of the actuation region or regions of at least one of the disengaging lever or levers receives one or more actuation forces, at least one of the action region or regions of at least one of the disengaging lever or levers is displaced, and at least one of the action region or regions of at least one of the disengaging lever or levers causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

Such access-controlling mechanism(s) and image forming apparatus(es) in accordance with the present invention also permit attainment of operation and benefits similar to those described with respect to the foregoing access-controlling mechanism(s).

DESCRIPTION OF PREFERRED EMBODIMENTS

Below, embodiments of the present invention are described in detail with reference to the attached drawings.

Figure 1:
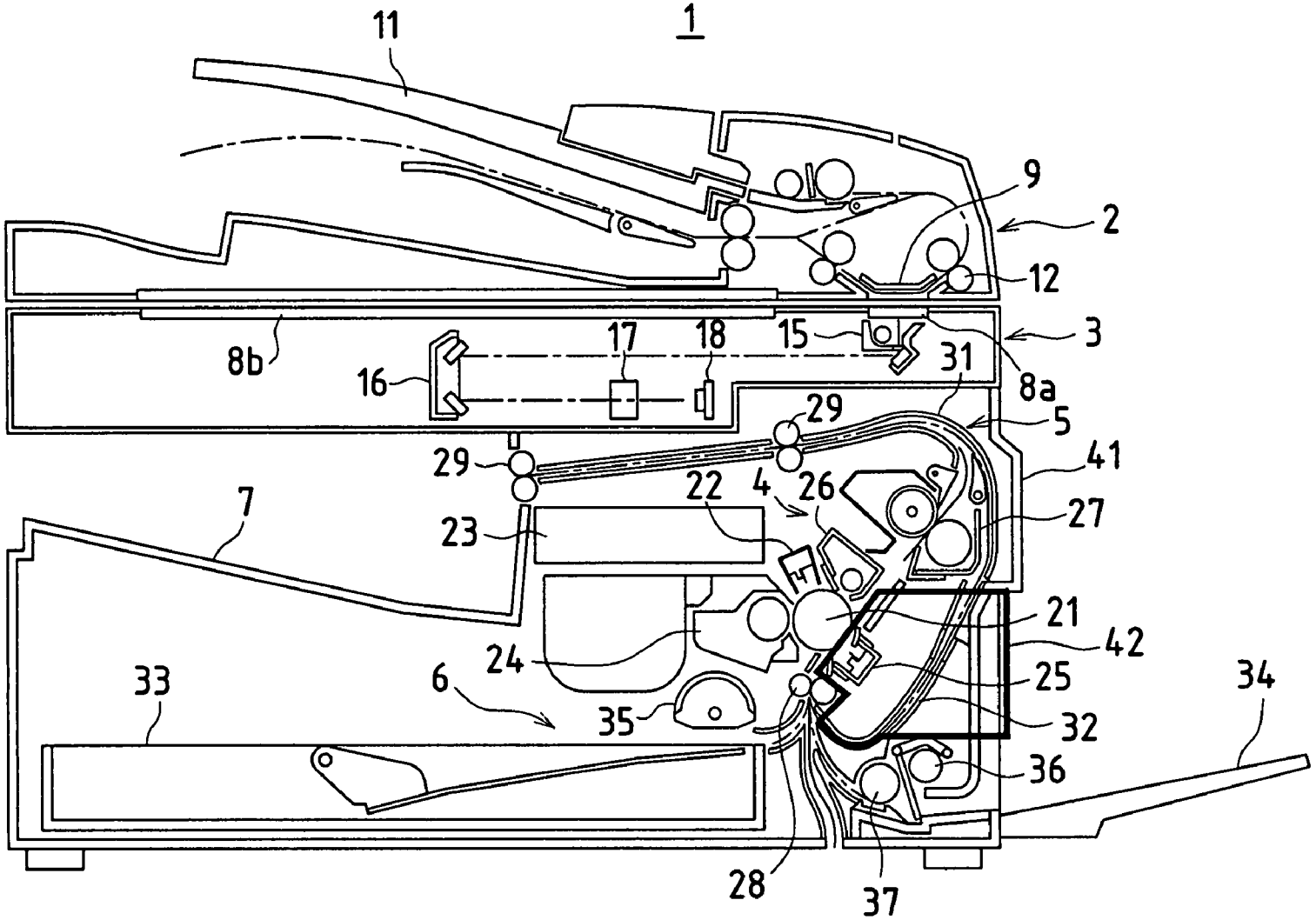
FIG. 1 is a side view showing an embodiment of an image forming apparatus in accordance with the present invention.

FIG. 1 is a side view showing an embodiment of an image forming apparatus in accordance with the present invention. The image forming apparatus 1 of the present embodiment comprises original transport subassembly or subassemblies 2, capturing subassembly or subassemblies 3, printing subassembly or subassemblies 4, recording paper transport subassembly or subassemblies 5, media supply subassembly or subassemblies 6, and media discharge tray(s) 7.

At original transport subassembly 2, when at least one original sheet is placed on original input tray 11, original(s) are taken up one sheet at a time from original input tray 11 and are transported; and when the leading edge of the original reaches PS roller pair 12, transport of the original is temporarily stopped and the leading edge of the original is made parallel to PS roller pair 12. Furthermore, after achieving synchronization with respect to image recording operations taking place at printing subassembly 4, clutch(es) between drive shaft(s) and PS roller pair 12 is/are engaged, causing PS roller pair 12 to be driven in rotating fashion; and transport of the original being resumed by PS roller pair 12, the original is made to pass between glass platen 8*a* and original backpressure plate 9.

At capturing subassembly 3, during transport of the original, first scanning unit 15 exposes the original; first and second scanning units 15, 16 direct light reflected from the original toward imaging lens(es) 17; and imaging lens(es) 17 form an image of the original on optical-to-electrical conversion element(s) (hereinafter "CCD") 18. CCD 18 captures the original through repeated scanning of same in the scan direction, and outputs image data representing the original.

Furthermore, in the event that the original is placed on glass platen 8*b*, first and second scanning units 15, 16 are made to move with prescribed relative speeds being maintained therebetween; first scanning unit 15 exposes the original on glass platen 8*b*; first and second scanning units 15, 16 direct light reflected from the original toward imaging lens(es) 17; and imaging lens(es) 17 form an image of the original on CCD 18.

Image data output by CCD 18 is subjected to various types of image processing carried out by microcomputer or other such control circuit(s) (not shown), and is thereafter output to printing subassembly 4.

Printing subassembly 4, which records image(s) of the original represented by the image data onto recording paper, comprises photosensitive drum(s) 21, charging unit(s) 22, laser scanning unit(s) (hereinafter "LSU") 23, developer unit(s) 24, transfer unit(s) 25, cleaning unit(s) 26, charge-removing unit(s) (not shown), fixing unit(s) 27, and so forth. Photosensitive drum 21 rotates in unidirectional fashion, and after the surface thereof has been cleaned by cleaning unit 26 and charge-removing unit(s), the surface thereof is uniformly charged by charging unit 22. Laser scanning unit 23 modulates laser light in correspondence to the image data and causes this laser light to be repeatedly scanned in the scan direction across the surface of photosensitive drum 21, forming an electrostatic latent image on the surface of photosensitive drum 21. Developer unit 24 supplies toner to the surface of photosensitive drum 21, developing the electrostatic latent image and forming a visible toner image on the surface of photosensitive drum 21. Transfer unit 25 transfers the visible toner image on the surface of photosensitive drum 21 onto recording paper transported thereto by recording paper transport subassembly 5. Fixing unit 27 applies heat and pressure to the recording paper, fixing the visible toner image on the recording paper. The recording paper is thereafter further transported toward media discharge tray 7 by recording paper transport subassembly 5, and is discharged.

For transport of recording paper, recording paper transport subassembly 5 comprises PS roller pair(s) 28, plurality of transport roller pairs 29, transport path(s) 31, flipping transport path(s) 32, and so forth. Transport path 31 accepts recording paper from media supply subassembly 6 and transports same toward printing subassembly 4, and also transports recording paper toward media discharge tray 7. Flipping transport path 32 accepts recording paper from printing subassembly 4, flipping recording paper such that front and back thereof are reversed before transporting recording paper back toward printing subassembly 4. Arranged at these transport paths 31, 32 are a plurality of detection switches for detecting passage of recording paper therethrough, control of recording paper transport timing and so forth being carried out in correspondence to detection occurring at the respective detection switches.

Media supply subassembly 6, which stores unused recording paper and which supplies this unused recording paper to recording paper transport subassembly 5, comprises media supply cassette(s) 33 and manual feed tray(s) 34. Stored in stacked fashion within media supply cassette 33 is recording paper, this recording paper being taken up one sheet at a time and transported therefrom by half-moon-shaped pickup roller(s) 35. Recording paper may also be loaded at manual feed tray 34, in which case the recording paper would be taken up by pickup roller(s) 36 and the recording paper would be transported by feed roller(s) 37. When recording paper is taken up from media supply cassette 33 and/or manual feed tray 34, transport of recording paper is temporarily stopped when the leading edge thereof reaches PS roller pair 28, and the leading edge of the recording paper is made parallel to PS roller pair 28, following which the recording paper is transported toward transfer unit 25 of printing subassembly 4 by PS roller pair 28.

Figure 2:
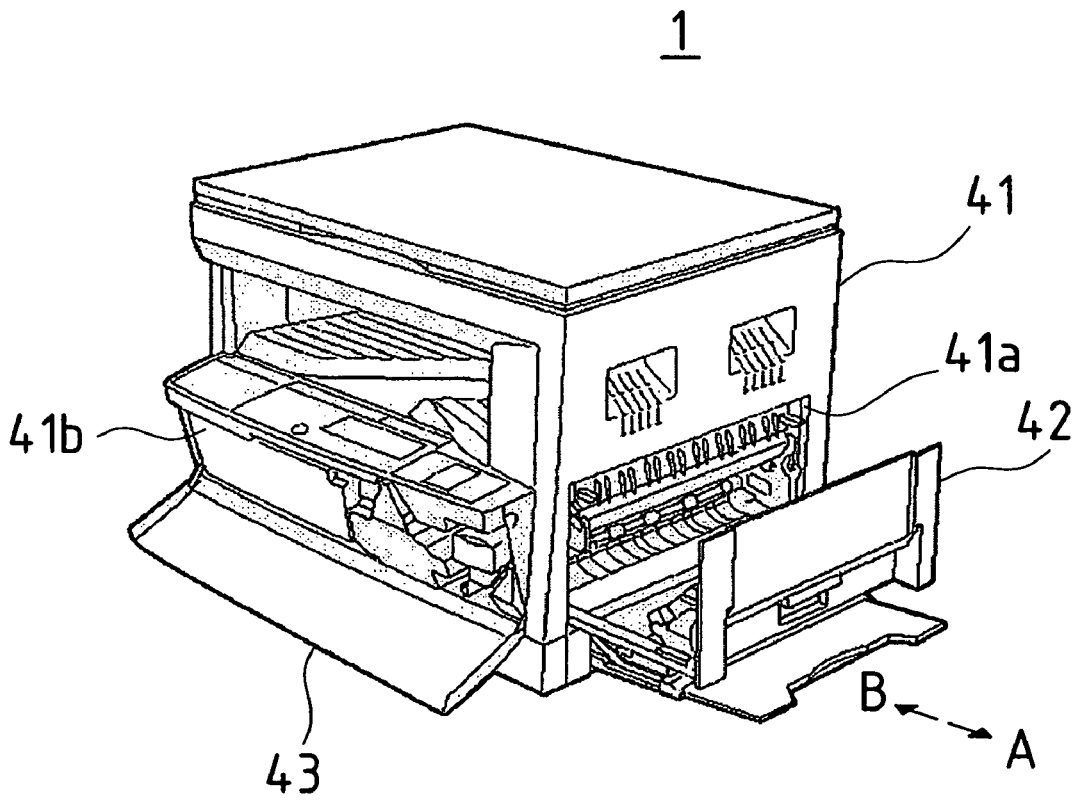
FIG. 2 is an oblique view showing the external appearance of the image forming apparatus of FIG. 1.

Now, as shown in FIG. 2, it so happens in the case of image forming apparatus 1 of the present embodiment that respective openings 41*a*, 41*b* are formed in the side walls of main body housing 41, and that access-controlling bodies 42, 43, which respectively open up and close off access at respective openings 41*a*, 41*b*, are provided thereat. These openings 41*a*, 41*b* are for removing recording paper in the event that jamming of recording paper occurs and/or for supplying recording paper, toner, and/or the like.

In particular, access-controlling body 42 possesses transfer unit 25 and flipping transport path 32; is supported so as to permit movement in the directions indicated by arrows A, B at the portion containing opening 41*a*; and can be moved in and out together with transfer unit 25 and flipping transport path 32.

Figure 3:
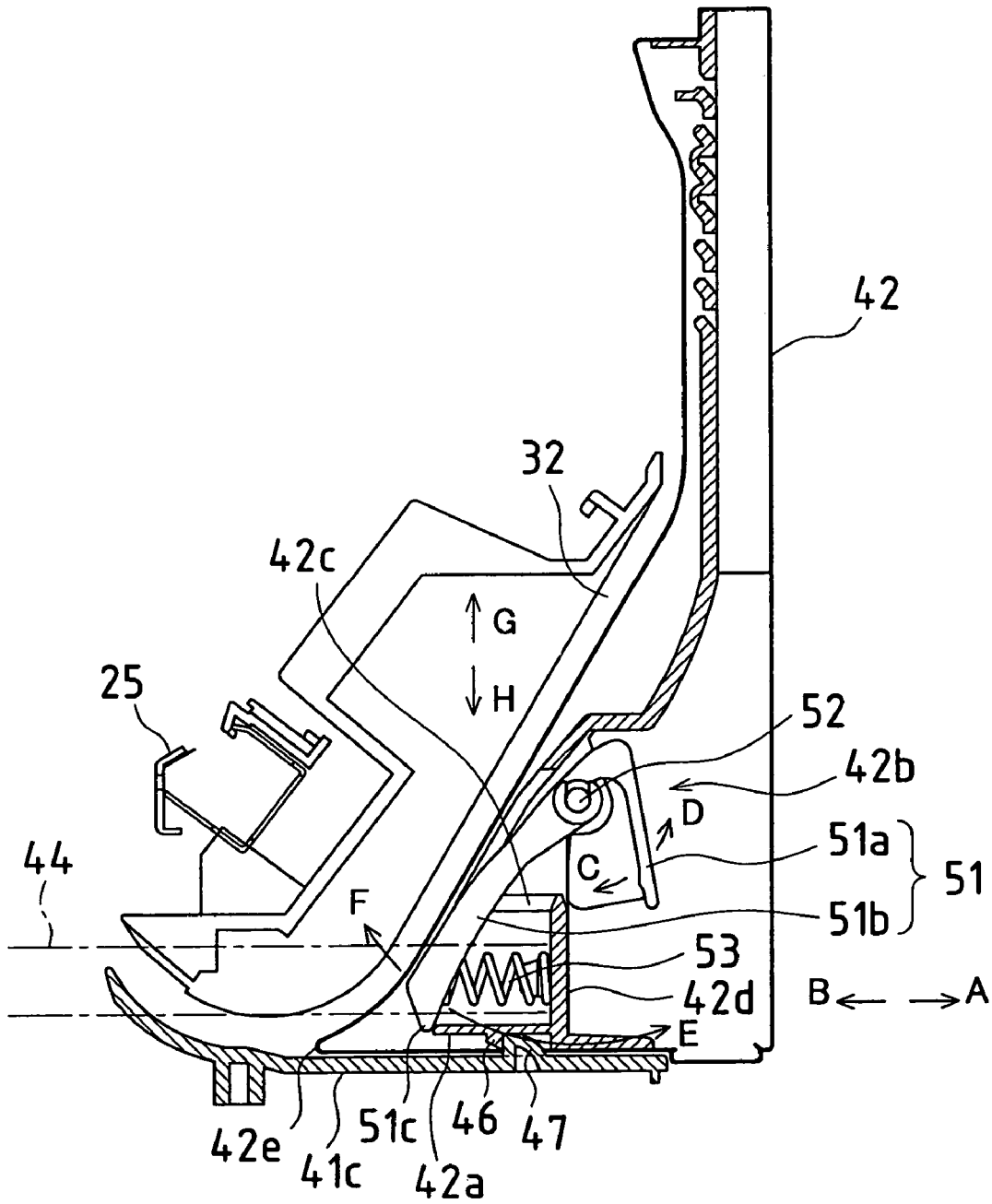
FIG. 3 is a side view showing the region surrounding an access-controlling body in the image forming apparatus of FIG. 1.
Figure 4:
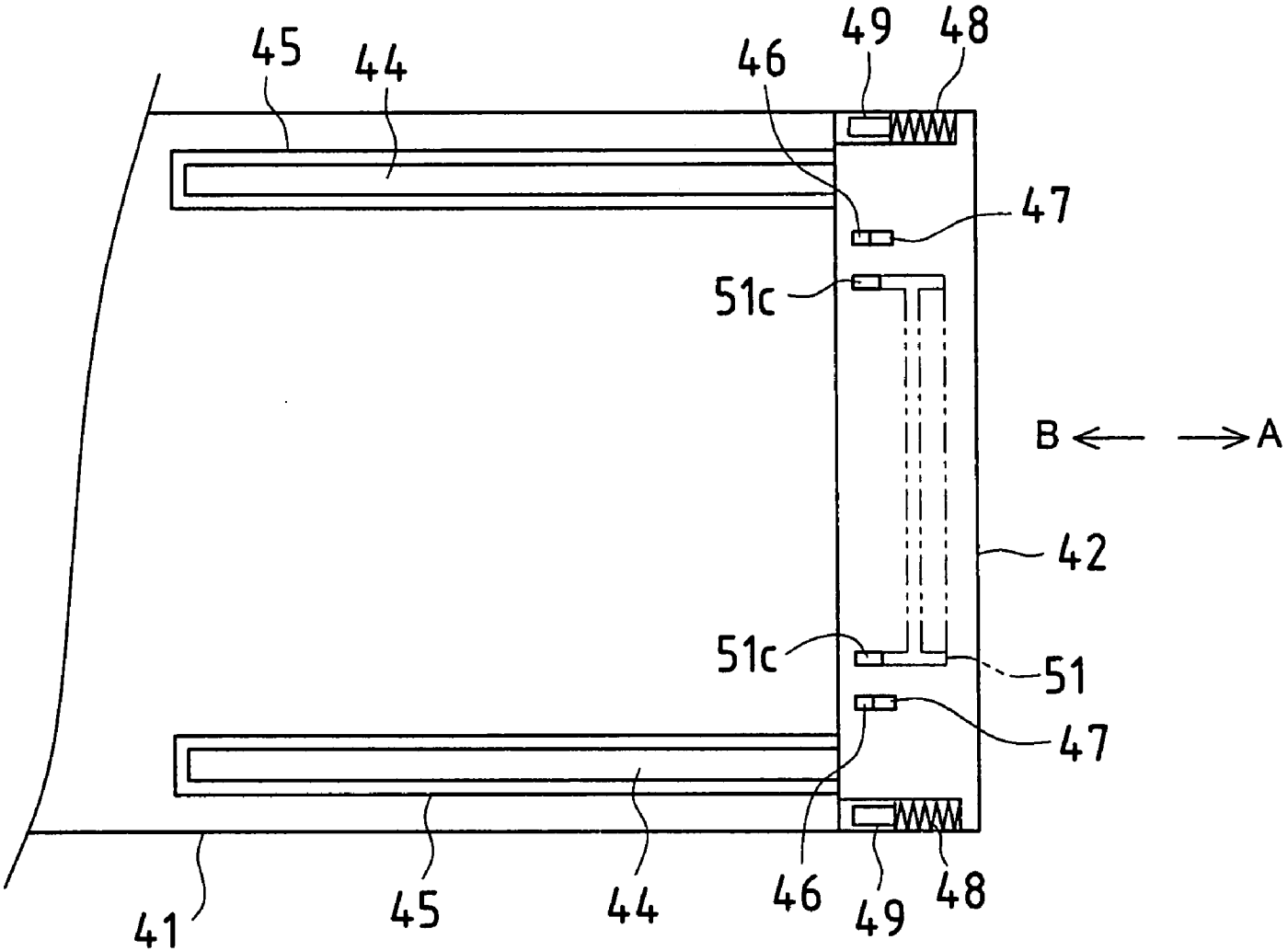
FIG. 4 is a plan view showing in schematic fashion the region surrounding an access-controlling body in the image forming apparatus of FIG. 1.

FIGS. 3 and 4 are side and plan views showing the region surrounding access-controlling body 42. As is clear from FIGS. 3 and 4, transfer unit 25 and flipping transport path 32 are arranged to the interior of access-controlling body 42.

Protruding from inside wall(s) of access-controlling body 42 are two sliding frames 44, respective sliding frames 44 being inserted into respective guide rails 45 of main body housing 41, with respective sliding frames 44 being supported so thereby as to permit movement in the directions indicated by arrows A, B.

Formed at base 42*a* of access-controlling body 42 are a pair of downwardly directed engagement projections 46, and formed at support plate 41*c* of main body housing 41 are a pair of upwardly directed engagement projections 47.

Figure 5:
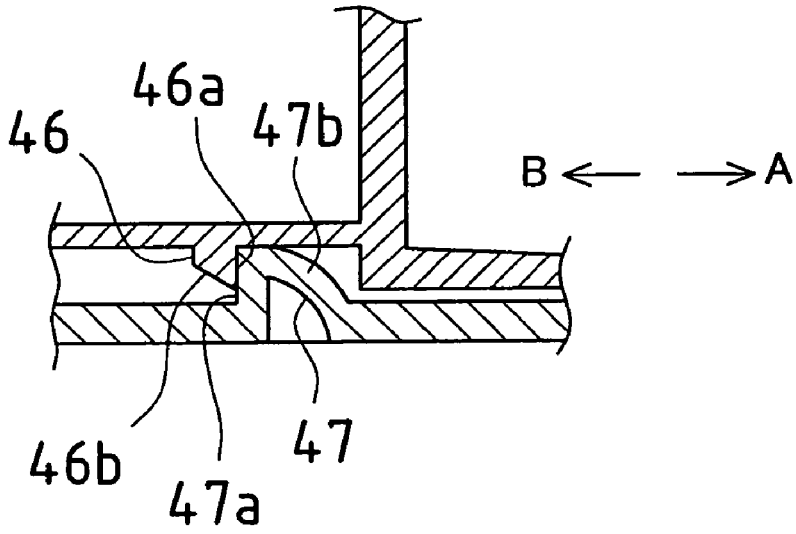
FIG. 5 is an enlarged side view showing respective upwardly directed engagement projection(s) of a main body housing and respective downwardly directed engagement projection(s) of the access-controlling body of FIG. 3.

As shown in FIG. 5, when respective downwardly directed engagement projections 46 of access-controlling body 42 and respective upwardly directed engagement projections 47 of main body housing 41 are mutually engaged, engagement surface(s) 46*a* of respective downwardly directed engagement projections 46 and engagement surface (s) 47*a* of respective upwardly directed engagement projections 47 are directed toward each other, keeping access-controlling body 42 from moving in the direction indicated by arrow A.

Furthermore, downwardly directed engagement projection 46 is positioned in the vicinity of an imaginary vertical line depending from the center of gravity of access-controlling body 42. This being the case, the weight of access-controlling body 42 acts in definitive fashion at engagement location(s) between respective downwardly directed engagement projections 46 and respective upwardly directed engagement projections 47, causing engagement therebetween to be maintained in definitive fashion.

A pair of springs 48 are secured to access-controlling body 42 such that there is one at each side thereof; and main body housing 41 is provided with a pair of spring seats 49. When respective downwardly directed engagement projections 46 of access-controlling body 42 and respective upwardly directed engagement projections 47 of main body housing 41 are mutually engaged, respective springs 48 of access-controlling body 42 are compressed and press on respective spring seats 49 of main body housing 41, elastic force(s) from respective springs 48 imparting access-controlling body 42 with restoring force(s) in the direction indicated by arrow A, and causing engagement surface(s) 46*a* of respective downwardly directed engagement projections 46 and engagement surface(s) 47*a* of respective upwardly directed engagement projections 47 to press against each other, accurately positioning access-controlling body 42 relative to main body housing 41.

Accordingly, when respective downwardly directed engagement projections 46 of access-controlling body 42 and respective upwardly directed engagement projections 47 of main body housing 41 are mutually engaged, not only is access-controlling body 42 kept from moving in the direction indicated by arrow A and not only does the weight of access-controlling body 42 cause engagement between respective downwardly directed engagement projections 46 and respective upwardly directed engagement projections 47 to be maintained in definitive fashion, but elastic force(s) from respective springs 48 cause access-controlling body 42 to be accurately positioned relative to main body housing 41. In other words, the position of access-controlling body 42 can be maintained in accurate and definitive fashion.

This being the case, transfer unit 25, which is located to the interior of access-controlling body 42, can be accurately positioned relative to photosensitive drum 21 and so forth of main body housing 41; and flipping transport path 32, which is located to the interior of access-controlling body 42, can be accurately positioned relative to transport path 31, PS roller pair 28, and so forth.

Furthermore, disengaging lever(s) 51 is/are arranged at the lower portion of the outside wall of access-controlling body 42. Disengaging lever 51 possesses handle region(s) 51*a* and rotating region(s) 51*b*. Rotating region 51*b* is rotatably supported by shaft 52 in the vicinity of the upper edge of rotating region 51*b*, rotating region 51*b* being made to pass from opening 42*c* in the outside wall of access-controlling body 42, therethrough, and into the interior such that a pair of action edges 51*c* of rotating region 51*b* oppose support plate 41*c* of main body housing 41.

Pushing or pulling handle region 51*a* in direction(s) indicated by arrows(s) C, D causes respective action edges 51*c* of rotating region 51*b* to move in rotating fashion about shaft 52 in direction(s) indicated by arrow(s) E, F, approaching support plate 41*c* of main body housing 41 or being drawn away from support plate 41*c*.

Because respective action edges 51*c* of rotating region 51*b* are arranged so as to be offset from respective downwardly directed engagement projections 46 and respective upwardly directed engagement projections 47 in direction(s) perpendicular to direction(s) indicated by arrow(s) A, B, respective action edges 51*c* come in contact with neither respective downwardly directed engagement projections 46 nor respective upwardly directed engagement projections 47 despite movement of respective action edges 51*c* in rotational fashion in direction(s) indicated by arrow(s) E, F. Furthermore, because respective action edges 51*c* of rotating region 51*b* are arranged at more or less identical location(s) as respective downwardly directed engagement projections 46 and respective upwardly directed engagement projections 47 in direction(s) indicated by arrow(s) A, B, it is possible to reduce the size of access-controlling body 42, as a result of which it is also, therefore, possible to reduce the size of main body housing 41.

Moreover, side wall(s) 42*d* of access-controlling body 42 supports spring(s) 53 in horizontal direction(s). Spring 53 imparts rotating region 51*b* of disengaging lever 51 with restoring force(s) in the direction indicated by arrow F, pressing rotating region 51*b* against the wall surface of access-controlling body 42 and positioning disengaging lever 51. This prevents disengaging lever 51 from accidentally moving and coming into contact with other member(s), and ensures that movement of access-controlling body 42 described hereinbelow is not impeded thereby.

Figure 6:
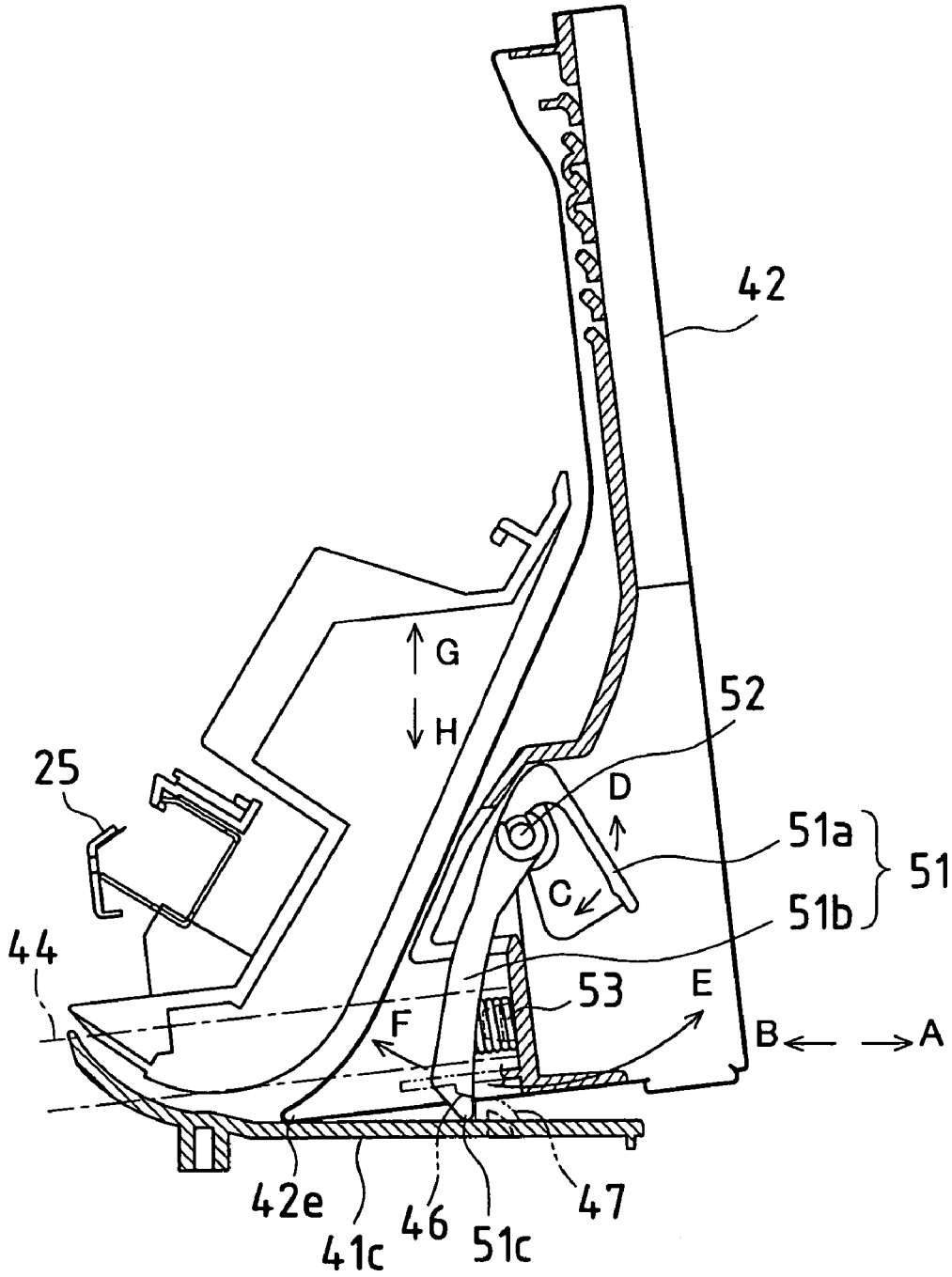
FIG. 6 is a side view showing the situation existing during actuation of a disengaging lever at the access-controlling body of FIG. 3.

Here, as shown in FIG. 6, when handle region 51*a* of disengaging lever 51 is pulled in the direction indicated by arrow D, respective action edges 51*c* of rotating region 51*b* rotate about shaft 52 in the direction indicated by arrow E. Upon being made to rotate in the direction indicated by arrow E, respective action edges 51*c* of rotating region 51*b* abut and slide along support plate 41*c* of main body housing 41, pressing on this support plate 41*c*. In accompaniment thereto, disengaging lever 51 moves upward as generally indicated by arrow G, and respectively downwardly directed engagement projections 46 of access-controlling body 42, as indicated by arrow (see particularly, FIG. 3), are lifted up and extricated from the corresponding respectively upwardly directed engagement projections 47 of main body housing 41.

At such time, access-controlling body 42 tilts and edge region(s) 42*e* of access-controlling body 42 press against support plate 41*c* of main body housing 41, access-controlling body 42 rotating about edge region(s) 42*e* of this access-controlling body 42, in accompaniment to which transfer unit 25, which is located to the interior of access-controlling body 42, is lowered in the direction of arrow H and promptly moves away from photosensitive drum 21 of main body housing 41.

Figure 7:
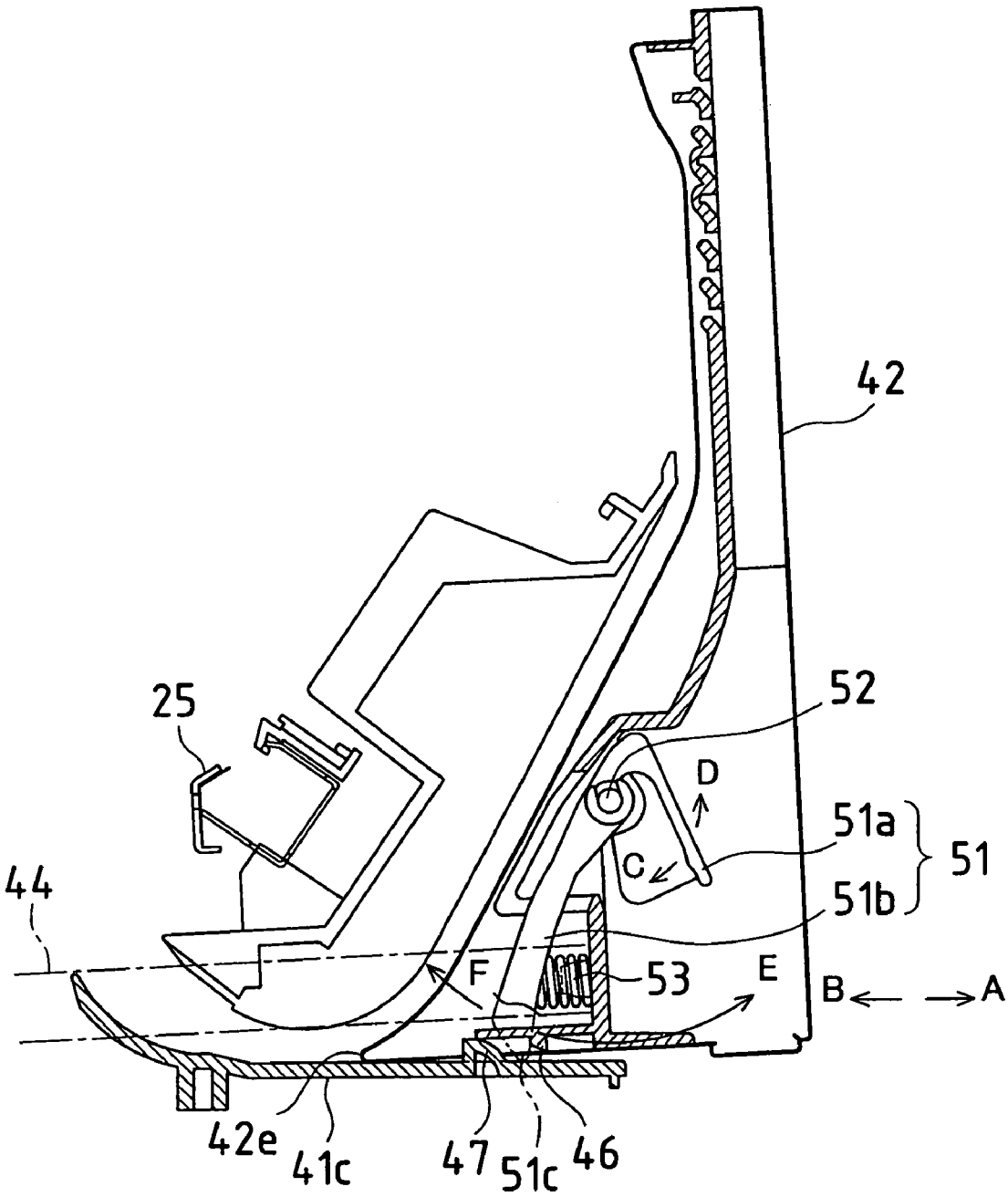
FIG. 7 is a side view showing the situation existing at some point during the course of an operation in which access is being opened up at the access-controlling body of FIG. 3.

Moreover, as shown in FIG. 7, when handle region 51*a* of disengaging lever 51 is pulled in the direction indicated by arrow D, respective sliding frames 44 of access-controlling body 42 move along respective guide rails 45 of main body housing 41 in the direction indicated by arrow A.

Figure 8:
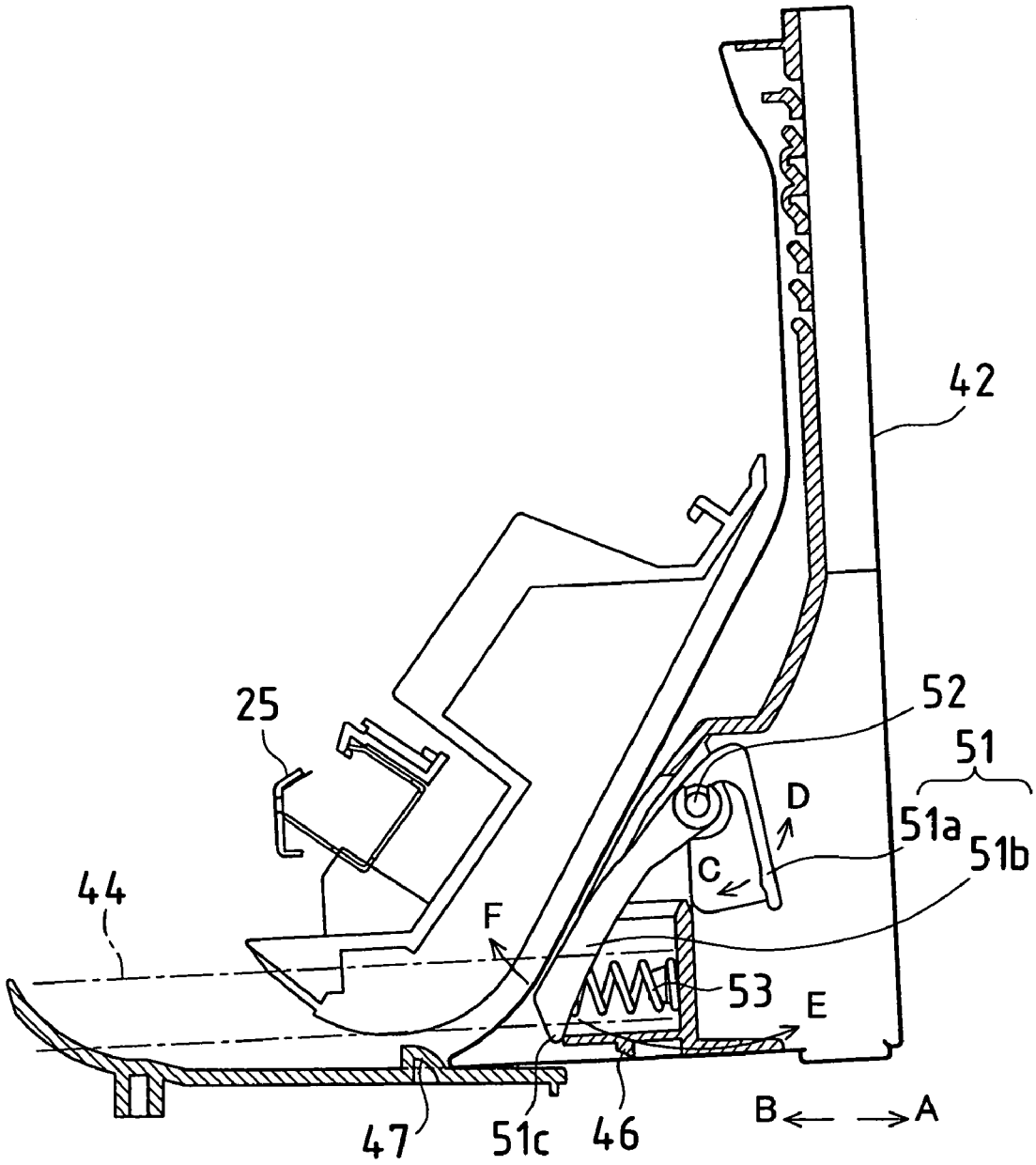
FIG. 8 is a side view showing the situation existing after access has been opened up at the access-controlling body of FIG. 3.
Figure 9:
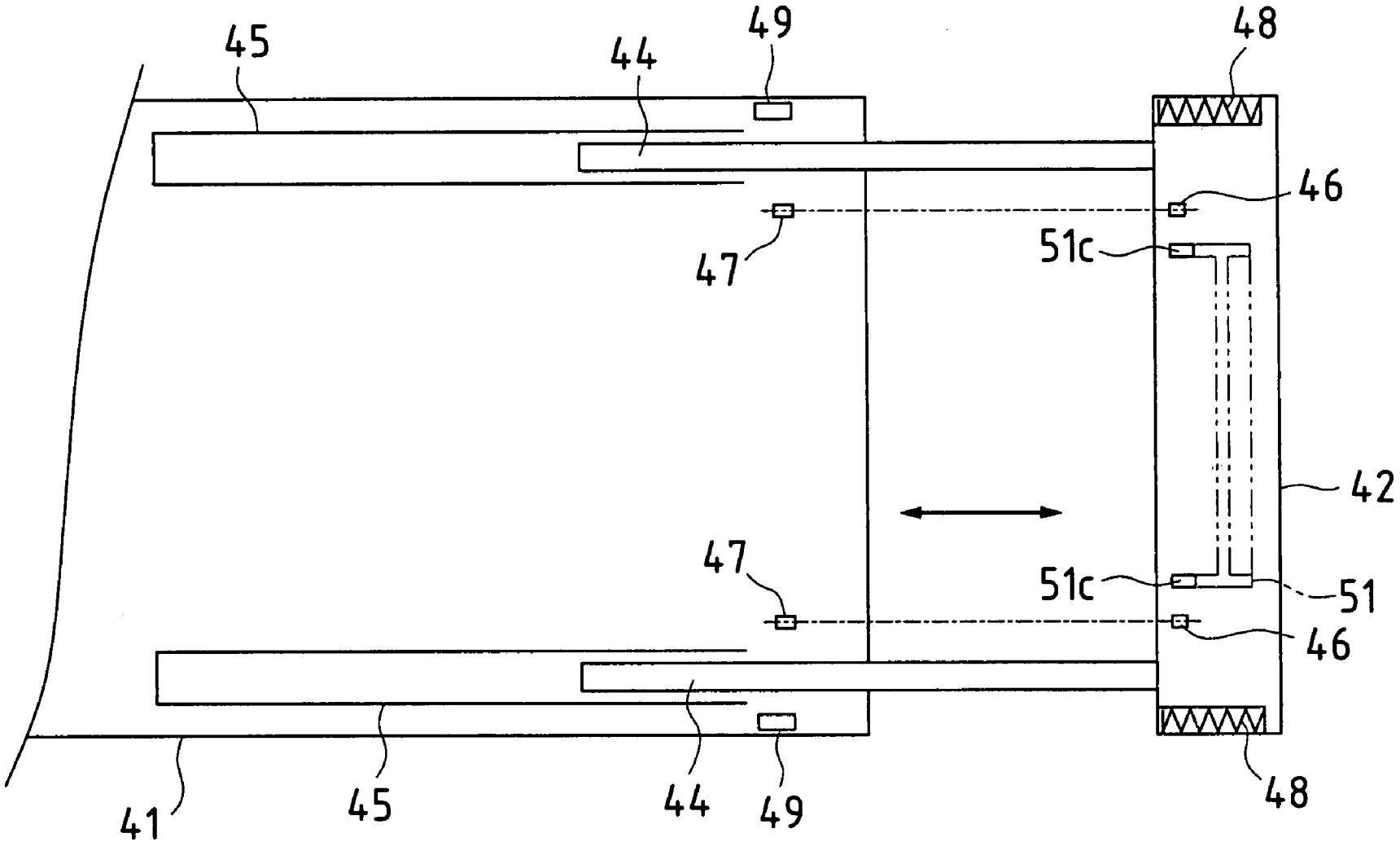
FIG. 9 is a side view showing in schematic fashion the situation existing after access has been opened up at the access-controlling body of FIG. 3.

As a result, as shown in FIGS. 8 and 9, access-controlling body 42 is pulled away from main body housing 41, greatly opening up access at opening 41*a* of main body housing 41. In addition, when handle region 51*a* of disengaging lever 51 is released, disengaging lever 51, acted upon by restoring force(s) from spring 53, returns to its initial position.

Accordingly, by simply pulling handle region 51*a* of disengaging lever 51 in the direction indicated by arrow D it is possible to cause respective downwardly directed engagement projections 46 of access-controlling body 42 to be extricated from respective upwardly directed engagement projections 47 of main body housing 41; and as access-controlling body 42 is drawn away in accompaniment to movement of disengaging lever 51, access is greatly opened up at opening 41*a* of main body housing 41.

Furthermore, when respective downwardly directed engagement projections 46 of access-controlling body 42 are extricated from respective upwardly directed engagement projections 47 of main body housing 41, access-controlling body 42 rotates about edge region(s) 42*e*; and transfer unit 25, which is located to the interior of access-controlling body 42, is lowered and promptly moves away from photosensitive drum 21 of main body housing 41. In addition, when access-controlling body 42 is pulled away, transfer unit 25 moves yet further away from photosensitive drum 21. Accordingly, it is possible to definitively avoid occurrence of contact between transfer unit 25 and photosensitive drum 21 while pulling out access-controlling body 42.

Furthermore, location(s) at which respective action edges 51*c* of disengaging lever 51 press on support plate 41*c* of main body housing 41 coincide with respective downwardly directed engagement projections 46 and respective upwardly directed engagement projections 47 in direction(s) indicated by arrow(s) A, B. This being the case, when respective action edges 51*c* of disengaging lever 51 impel support plate 41*c* of main body housing 41, respective downwardly directed engagement projections 46 of access-controlling body 42 move in only an upward direction as indicated by arrow G, without occurrence of lateral deviation, and are definitively extricated from respective upwardly directed engagement projections 47 of main body housing 41. Furthermore, this can be accomplished without unnecessary application of load on respective downwardly directed engagement projections 46 and/or respective upwardly directed engagement projections 47.

Moreover, location(s) at which respective action edges 51*c* of disengaging lever 51 press on support plate 41*c* of main body housing 41 is/are in vicinity or vicinities of respective downwardly directed engagement projections 46 and respective upwardly directed engagement projections 47, and is/are also in vicinity or vicinities of an imaginary vertical line depending from the center of gravity of access-controlling body 42. This being the case, almost all of the force with which respective action edges 51*c* of disengaging lever 51 impel support plate 41*c* of main body housing 41 acts not so as to cause access-controlling body 42 to move in horizontal direction(s) but acts so as to cause access-controlling body 42 to be lifted up in vertical direction(s). As a result, the force required to operate disengaging lever 51 is small.

Next, when access-controlling body 42 is pushed in the direction indicated by arrow C, respective sliding frames 44 of access-controlling body 42 move along respective guide rails 45 of main body housing 41 in the direction indicated by arrow B. At such time, disengaging lever 51, acted upon by restoring force(s) from spring 53, is returned to its initial position. In addition, as sloped surface(s) 46*b* (shown in FIG. 5) of respective downwardly directed engagement projections 46 of access-controlling body 42 come in sliding contact with sloped surface(s) 47*b* (shown in FIG. 5) of respective upwardly directed engagement projections 47 of main body housing 41, respective downwardly directed engagement projections 46 surmount respective upwardly directed engagement projections 47, causing respective downwardly directed engagement projections 46 and respective upwardly directed engagement projections 47 to become mutually engaged. Moreover, respective springs 48 of access-controlling body 42 are compressed and press on respective spring seats 49 of main body housing 41, and elastic force(s) from respective springs 48 cause engagement surface(s) 46*a* of respective downwardly directed engagement projections 46 and engagement surface(s) 47*a* of respective upwardly directed engagement projections 47 to press against each other, accurately positioning access-controlling body 42 relative to main body housing 41. As a result, access is closed off at opening 41*a* of main body housing 41.

Accordingly, by simply pushing access-controlling body 42 in the direction indicated by arrow C it is possible to cause access-controlling body 42 to be pressed thereinto, closing off opening 41*a* of main body housing 41.

Thus, in the present embodiment, by simply pulling handle region 51*a* of disengaging lever 51 it is possible to cause respective downwardly directed engagement projections 46 to be extricated from respective upwardly directed engagement projections 47; and as access-controlling body 42 is drawn away, access is greatly opened up at opening 41*a* of main body housing 41. This facilitates any servicing to be carried out at the interior of main body housing 41, as well as at transfer unit 25 and flipping transport path 32, which are located to the interior of access-controlling body 42.

Furthermore, when access-controlling body 42 is pressed in and access is closed off at opening 41*a* of main body housing 41, not only does the weight of access-controlling body 42 cause engagement between respective downwardly directed engagement projections 46 and respective upwardly directed engagement projections 47 to be maintained in definitive fashion, but elastic force(s) from respective springs 48 cause access-controlling body 42 to be accurately positioned relative to main body housing 41.

Moreover, because respective downwardly directed engagement projections 46 and respective upwardly directed engagement projections 47 are simple structural components, they possess adequate strength and positional accuracy of access-controlling body 42 does not deteriorate.

Note also that changes may be made as appropriate in the location(s) of shaft 52, handle region 51*a*, and/or respective action edge(s) 51*c* of disengaging lever 51; in the location(s) of respective downwardly directed engagement projection (s) 46 of access-controlling body 42 and/or of respective upwardly directed engagement projection(s) 47 of main body housing 41; and so forth. For example, changes may be made in the distance(s) between shaft 52 and respective action edge(s) 51*c* of disengaging lever 51. The farther that respective action edge(s) 51*c* is/are moved away from shaft 52 and toward main body housing 41, the greater will be the force required to actuate handle region 51*a* of disengaging lever 51, and the shorter will be the actuation stroke at handle region 51*a*. Furthermore, plate spring(s) and/or the like may be employed instead of coil spring(s) at spring(s) 48, 53.

Figure 10:
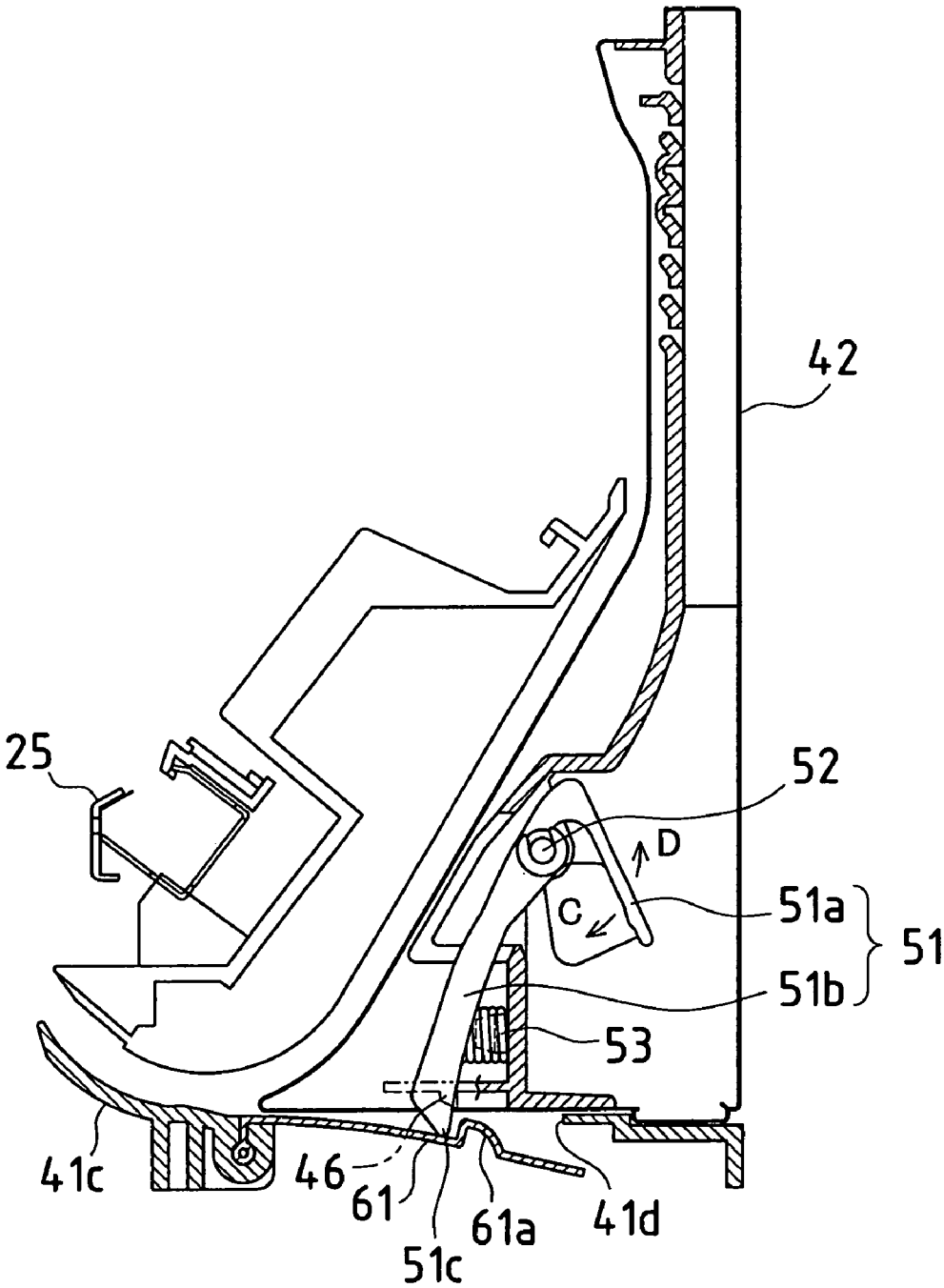
FIG. 10 is a side view showing a variation on a mechanism for causing engagement of an access-controlling body.

FIG. 10 is a side view showing a variation on a mechanism for causing engagement of access-controlling body 42. In this variation, instead of respective upwardly directed engagement projections 47 at main body housing 41, opening(s) 41*d* is/are formed in support plate(s) 41*c*, respective plate spring(s) 61 being at one end secured to location(s) in vicinity or vicinities of edge(s) of opening(s) 41*d* such that upwardly directed engagement projection(s) 61*a* of respective plate spring(s) 61 face upward from opening(s) 41*d*.

When access is closed off at opening 41*a* of main body housing 41, upwardly directed engagement projections 61*a* of respective plate springs 61 at main body housing 41 engage with respective downwardly directed engagement projections 46 of access-controlling body 42, positioning and securing access-controlling body 42.

When handle region 51*a* of disengaging lever 51 is pulled, respective action edges 51*c* of rotating region 51*b* move in rotating fashion and impel respective plate springs 61, causing upwardly directed engagement projections 61*a* of respective plate springs 61 to be extricated from respective downwardly directed engagement projections 46 of access-controlling body 42. In addition, when access-controlling body 42 is pulled away further, access is greatly opened up at opening 41*a* of main body housing 41.

When handle region 51*a* of disengaging lever 51 is pushed, access-controlling body 42 is pushed back and is returned to its previous location in accompaniment to movement of disengaging lever 51, and sloped surface(s) 46*b* (shown in FIG. 5) of respective downwardly directed engagement projections 46 of access-controlling body 42 push down on and surmount upwardly directed engagement projections 61*a* of respective plate springs 61 of main body housing 41, causing upwardly directed engagement projections 61*a* of respective plate springs 61 to become engaged with respective downwardly directed engagement projections 46, positioning and securing access-controlling body 42.

Figure 11:
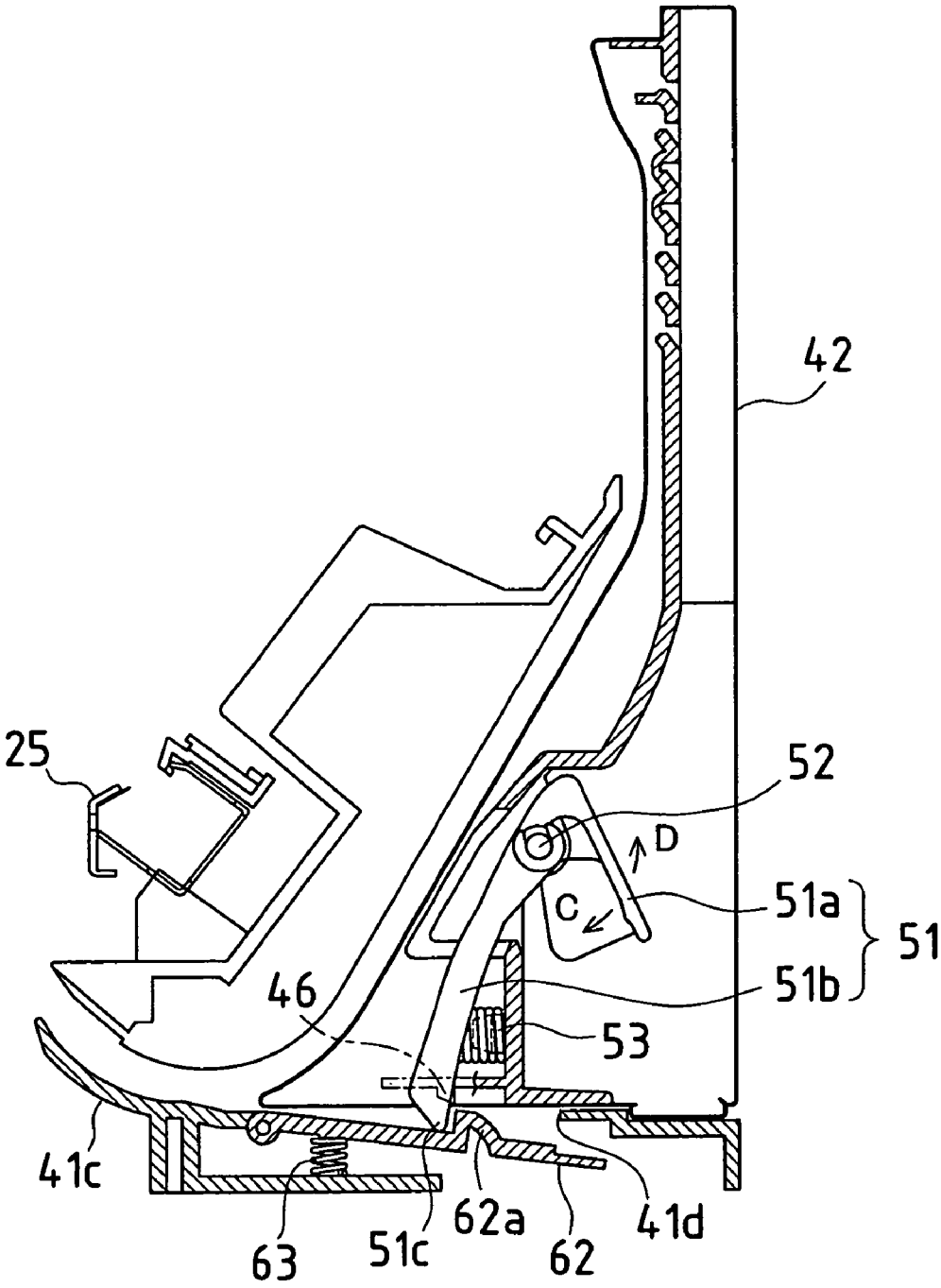
FIG. 11 is a side view showing another variation on a mechanism for causing engagement of an access-controlling body.

FIG. 11 is a side view showing another variation on a mechanism for causing engagement of access-controlling body 42. In this other variation, instead of respective upwardly directed engagement projections 47 at main body housing 41, opening(s) 41*d* is/are formed in support plate(s) 41*c*, and respective arm(s) 62 is/are at one end pivotably supported in vicinity or vicinities of edge(s) of opening(s) 41*d*, respective arm(s) 62 being urged upward by restoring force(s) from respective springs 63 such that upwardly directed engagement projection(s) 62*a* of respective arm(s) 62 face upward from opening(s) 41*d*.

When access is closed off at opening 41*a* of main body housing 41, upwardly directed engagement projection(s) 62*a* of respective arm(s) 62 at main body housing 41 engage with respective downwardly directed engagement projections 46 of access-controlling body 42, positioning and securing access-controlling body 42.

When handle region 51*a* of disengaging lever 51 is pulled, respective action edges 51*c* of rotating region 51*b* move in rotating fashion and impel respective arms 62, causing upwardly directed engagement projections 62*a* of respective arms 62 to be extricated from respective downwardly directed engagement projections 46 of access-controlling body 42. In addition, when access-controlling body 42 is pulled away further, access is greatly opened up at opening 41*a* of main body housing 41.

When handle region 51*a* of disengaging lever 51 is pushed, access-controlling body 42 is pushed back and is returned to its previous location in accompaniment to movement of disengaging lever 51, and sloped surface(s) 46*b* (shown in FIG. 5) of respective downwardly directed engagement projections 46 of access-controlling body 42 push down on and surmount upwardly directed engagement projections 62*a* of respective arms 62 of main body housing 41, causing upwardly directed engagement projections 62*a* of respective arms 62 to become engaged with respective downwardly directed engagement projections 46, positioning and securing access-controlling body 42.

Figure 12:
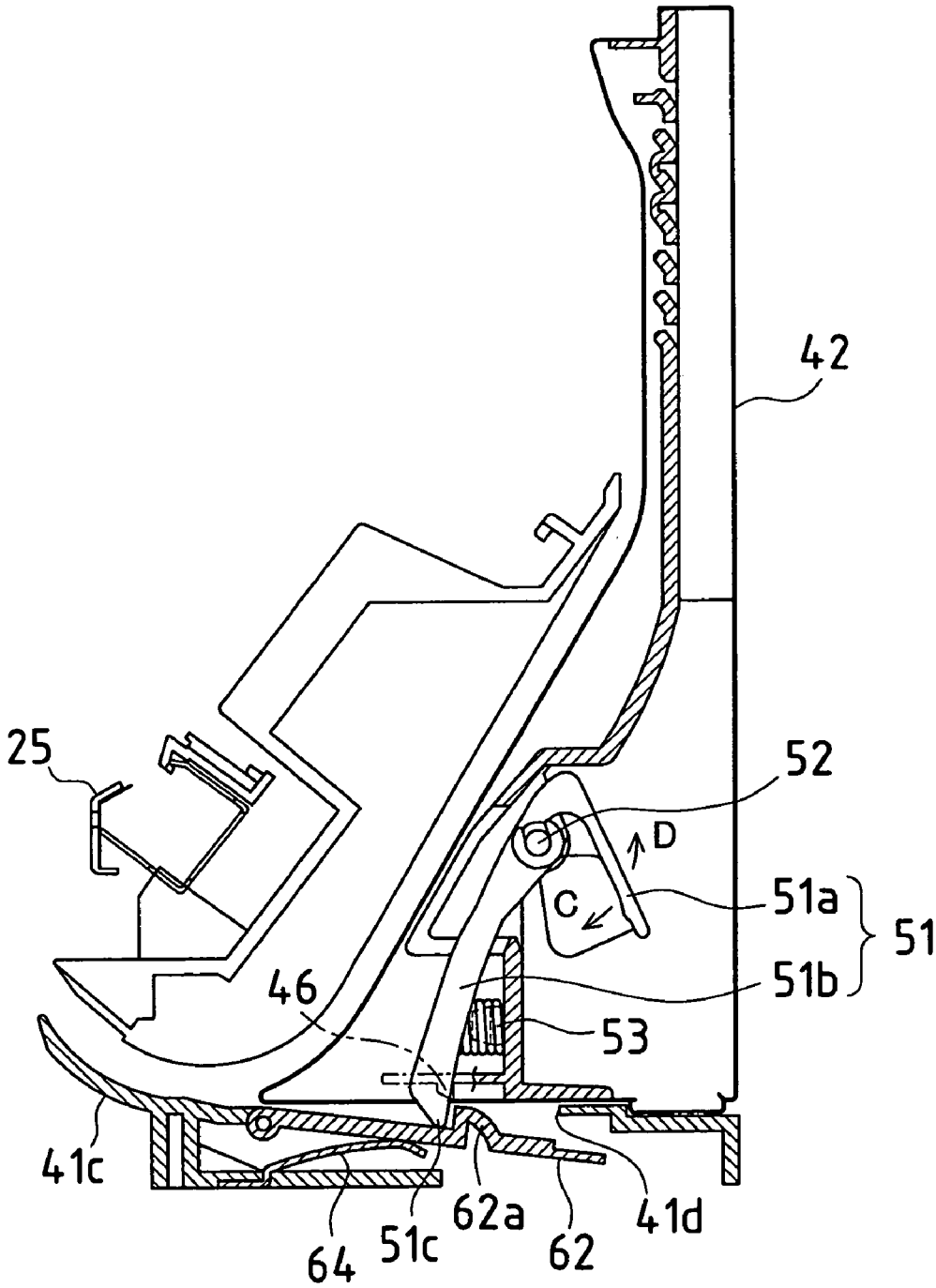
FIG. 12 is a side view showing a different variation on a mechanism for causing engagement of an access-controlling body.

FIG. 12 is a side view showing a different variation on a mechanism for causing engagement of access-controlling body 42. In this different variation, instead of respective springs 63 of FIG. 11, respective plate spring(s) 64 is/are provided, respective arm(s) 62 being urged upward by restoring force(s) from respective plate spring(s) 64 such that upwardly directed engagement projection(s) 62*a* of respective arm(s) 62 face upward from opening(s) 41*d*.

Figure 13:
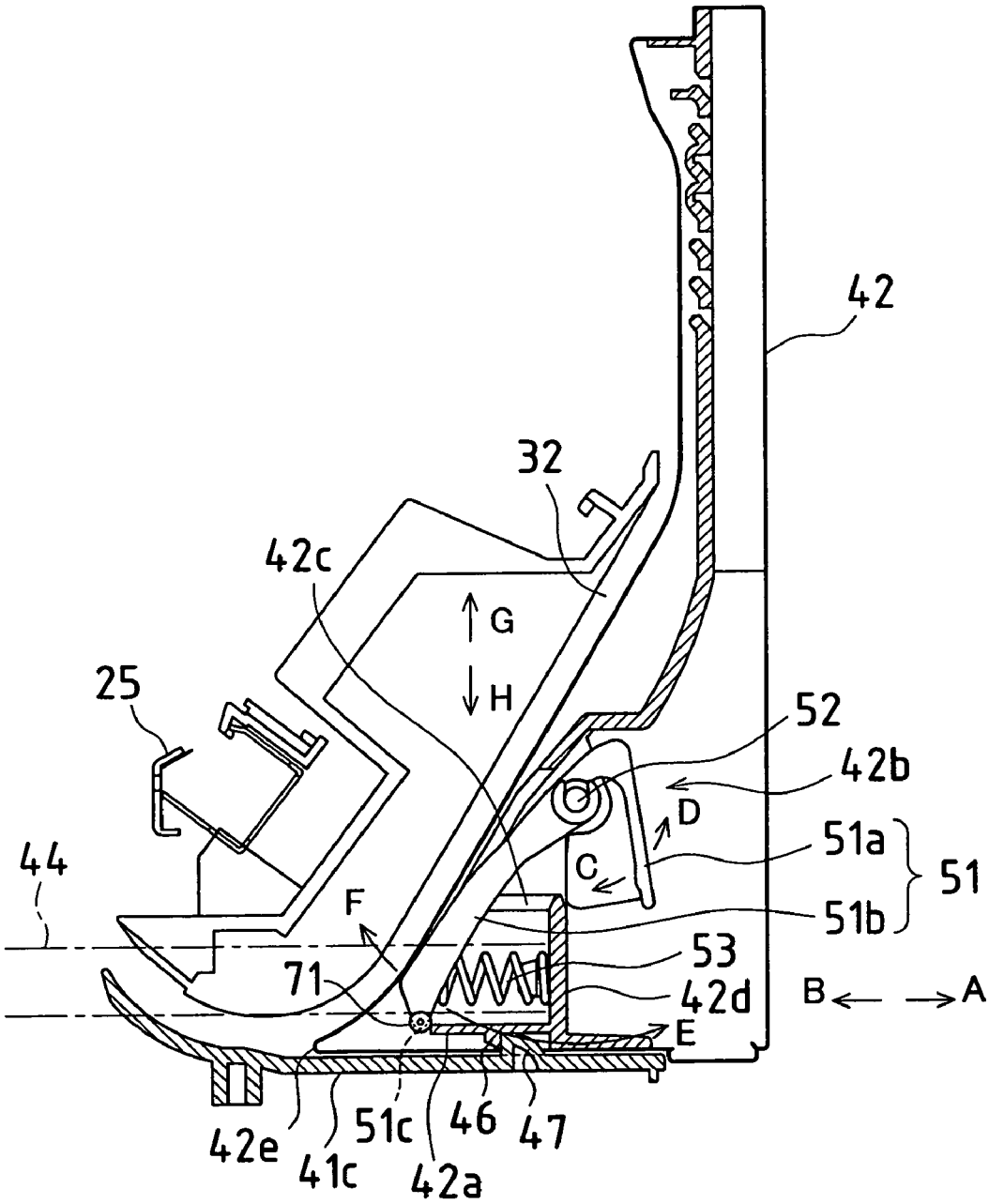
FIG. 13 is a side view showing the region surrounding an access-controlling body at an image forming apparatus in a second embodiment.

FIG. 13 is a side view showing the region surrounding access-controlling body 42 at an image forming apparatus in a second embodiment. Note that, at FIG. 13, components functioning in like manner to those at FIG. 3 have been given like reference numerals.

In the present embodiment, respective cylindrical roller(s) 71 is/are rotatably supported in shaft-like fashion by respective action edge(s) 51*c* of disengaging lever 51. Respective roller(s) 71 may, instead of being cylindrical, be spherical and/or the like.

Figure 14:
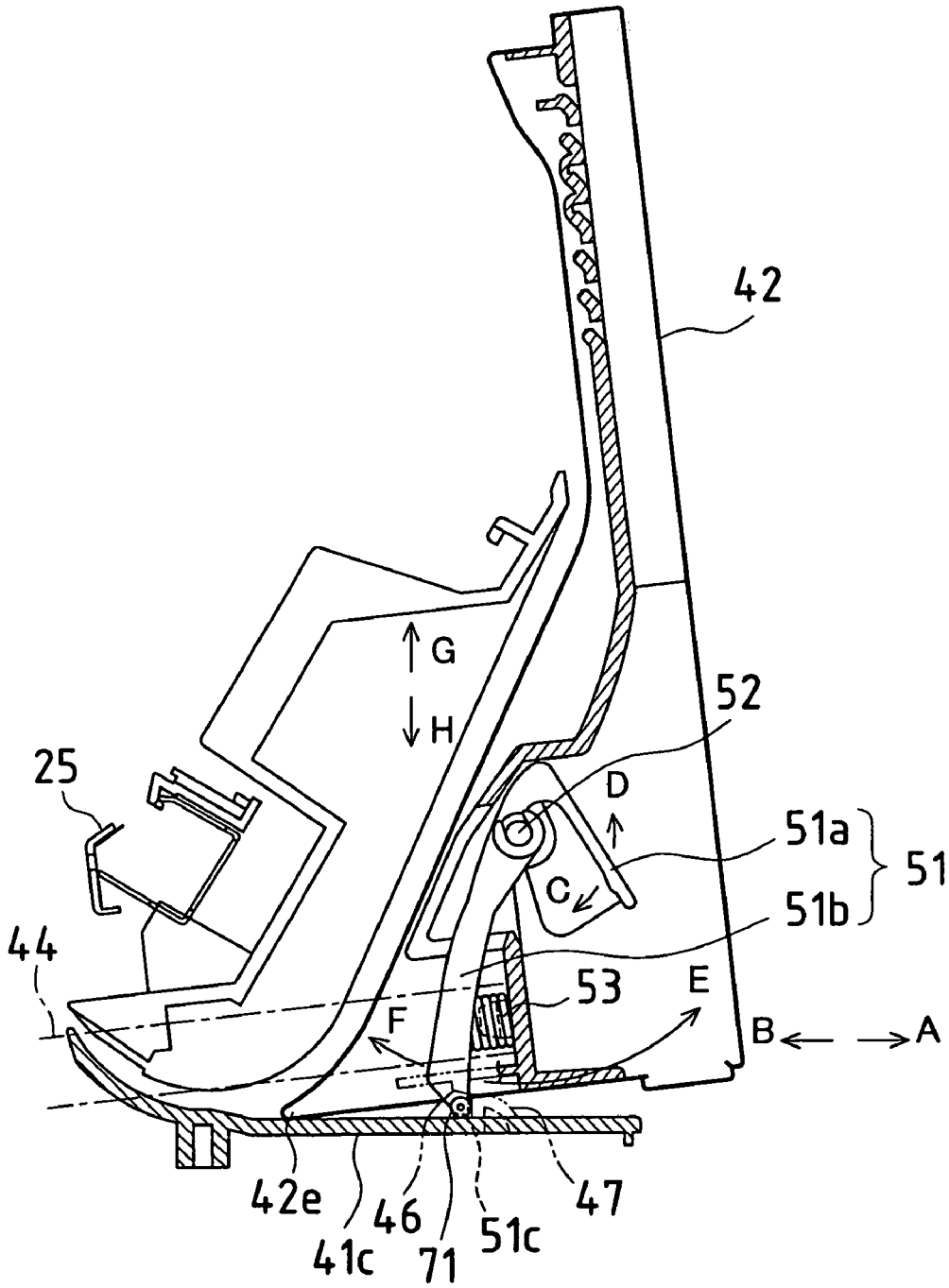
FIG. 14 is a side view showing the situation existing during actuation of a disengaging lever at the access-controlling body of FIG. 13.

Now, as shown in FIG. 14, when handle region 51*a* of disengaging lever 51 is pulled in the direction indicated by arrow D, respective action edges 51*c* of rotating region 51*b* rotate about shaft 52 in the direction indicated by arrow E. Moreover, roller(s) 71 at respective action edges 51*c* abut support plate 41*c* of main body housing 41 and move in rotating fashion, pressing on this support plate 41*c*. As a result, the respective downwardly directed engagement projections 46 of access-controlling body 42 are, as indicated by arrow G, lifted up and extricated from respectively upwardly directed engagement projections 47 of main body housing 41. Furthermore, access-controlling body 42, and in accompaniment thereto, transfer unit 25, which is located to the interior of access-controlling body 42, is lowered in the direction of arrow H and promptly moves away from photosensitive drum 21 of main body housing 41.

At such time, because it is only rolling resistance that is produced between support plate 41*c* and roller(s) 71 of respective action edges 51*c*, pulling of handle region 51*a* of disengaging lever 51 can be accomplished with little force, improving ease of operation of disengaging lever 51.

Figure 15:
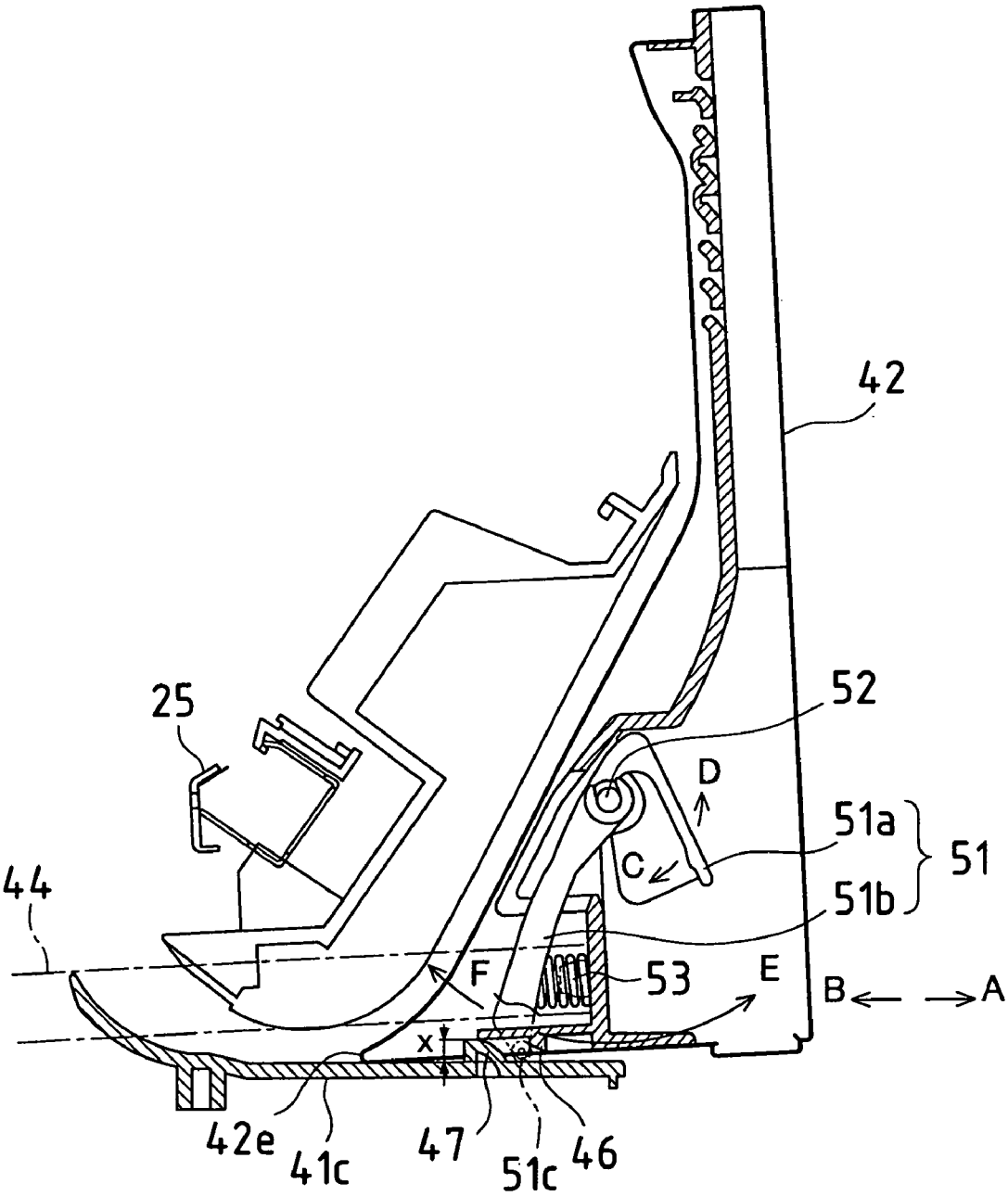
FIG. 15 is a side view showing the situation existing at some point during the course of an operation in which access is being opened up at the access-controlling body of FIG. 13.

Moreover, as shown in FIG. 15, when handle region 51*a* of disengaging lever 51 is pulled in the direction indicated by arrow D, respective sliding frames 44 of access-controlling body 42 move along respective guide rails 45 of main body housing 41 in the direction indicated by arrow A.

At such time as well, because roller(s) 71 of respective action edges 51*c* abut support plate 41*c* and move therealong in rotating fashion, it is only rolling resistance that is produced between support plate 41*c* and roller(s) 71 of respective action edges 51*c*. For this reason, pulling of access-controlling body 42 can be accomplished with little force, improving ease of operations in connection with access-controlling body 42.

Next, when access-controlling body 42 is pushed in the direction indicated by arrow C, respective sliding frames 44 of access-controlling body 42 move along respective guide rails 45 of main body housing 41 in the direction indicated by arrow B. In addition, as sloped surface(s) 46*b* of respective downwardly directed engagement projections 46 of access-controlling body 42 come in sliding contact with sloped surface(s) 47*b* of respective upwardly directed engagement projections 47 of main body housing 41, respective downwardly directed engagement projections 46 surmount respective upwardly directed engagement projections 47, causing respective downwardly directed engagement projections 46 and respective upwardly directed engagement projections 47 to become mutually engaged.

Moreover, respective springs 48 of access-controlling body 42 are compressed and press on respective spring seats 49 of main body housing 41, and elastic force(s) from respective springs 48 cause engagement surface(s) 46*a* of respective downwardly directed engagement projections 46 and engagement surface(s) 47*a* of respective upwardly directed engagement projections 47 to press against each other, accurately positioning access-controlling body 42 relative to main body housing 41.

It is also desirable, when access is closed off at access-controlling body 42, that handle region 51*a* of disengaging lever 51 be pulled in the direction indicated by arrow D. When handle region 51*a* is pulled, respective action edges 51*c* of rotating region 51*b* rotate in the direction indicated by arrow E, and roller(s) 71 of respective action edges 51*c* abut support plate 41*c* of main body housing 41 and move in rotating fashion. This makes it possible to cause access-controlling body 42 to move in prompt fashion. Furthermore, because roller(s) 71 of respective action edges 51*c* press on support plate 41*c*, lifting respective downwardly directed engagement projections 46 of access-controlling body 42 in the direction indicated by arrow G to some extent, respective downwardly directed engagement projections 46 surmount respective upwardly directed engagement projections 47 with little effort. As a result, impact during closing off of access at access-controlling body 42 is mitigated, further improving the accuracy with which access-controlling body 42 can be positioned.

Thus, in the present embodiment, because respective action edges 51*c* of disengaging lever 51 are provided with respective roller(s) 71, at time(s) when handle region 51*a* of disengaging lever 51 is pulled in the direction indicated by arrow D, roller(s) 71 of respective action edges 51*c* abut support plate 41*c* of main body housing 41 and move in rotating fashion. This being the case, ease of operation during opening up of and closing off of access at access-controlling body 42 is improved, and moreover, impact during closing off of access at access-controlling body 42 is mitigated, further improving the accuracy with which access-controlling body 42 can be positioned.

Furthermore, in the case of the access-controlling body 42 shown in FIGS. 3 and 4, respective action edges 51*c* of rotating region 51*b* are arranged so as to be offset from respective downwardly directed engagement projections 46 and respective upwardly directed engagement projections 47 in direction(s) perpendicular to direction(s) indicated by arrow(s) A, B, such that respective action edges 51*c* do not come in contact with respective upwardly directed engagement projections 47.

But where respective roller(s) 71 is/are provided as in the present embodiment, respective action edges 51*c* of rotating region 51*b* may be arranged so as to coincide with respective downwardly directed engagement projections 46 and respective upwardly directed engagement projections 47 in direction(s) perpendicular to direction(s) indicated by arrow (s) A, B, such that respective action edges 51*c* come in contact with respective upwardly directed engagement projections 47. This is because, even though respective action edges 51*c* may come in contact with respective upwardly directed engagement projections 47, respective action edges 51*c* of rotating region 51*b* move in rotating fashion in the direction indicated by arrow E and roller(s) 71 of respective action edges 51*c* surmount respective upwardly directed engagement projections 47.

Here, it is preferred that diameter(s) of roller(s) 71 of action edges 51*c* be approximately equal to and/or slightly greater than height(s) x (see FIG. 15) of respective upwardly directed engagement projections 47. Where this is the case, respective roller(s) 71 will easily surmount respective upwardly directed engagement projections 47 and/or sensation(s) of resistance arising when respective roller(s) 71 surmount respective upwardly directed engagement projections 47 will be transmitted via disengaging lever 51 to person(s) performing actuation, making for good ease of operations. If diameter(s) of respective roller(s) 71 were to be made too small relative to height(s) x of respective upwardly directed engagement projections 47 then it would be difficult for respective roller(s) 71 to surmount respective upwardly directed engagement projections 47; conversely, if diameter(s) of respective roller(s) 71 were to be made too large relative to height(s) x of respective upwardly directed engagement projections 47 then sensation(s) of resistance arising when respective roller(s) 71 surmount respective upwardly directed engagement projections 47 would no longer be transmitted via disengaging lever 51 to person(s) performing actuation.

Note that the present invention is not limited to the foregoing embodiments and variations thereof but admits of a great many variations thereon. For example, changes may be made in shape(s) and/or location(s) of disengaging lever (s), and/or in shape(s) and/or location(s) of respective engagement projection(s). Where, as at FIGS. 10 through 12, elastic member(s) deliver restoring force(s) urging engagement projection(s) at main body housing(s) 41 toward access-controlling body or bodies 42, because it will be possible to cause engagement projection(s) at main body housing(s) 41 to engage in definitive fashion with engagement projection(s) at access-controlling body or bodies 42 without the need to rely on weight(s) of access-controlling body or bodies 42, respective engagement projection(s) may be arranged to the side(s) and/or above access-controlling body or bodies. Location(s) of disengaging lever(s) may, of course, be changed.

Furthermore, access-controlling body or bodies may be arranged at other opening(s) of the image forming apparatus. Moreover, application of the present invention is not limited to image forming apparatuses but may be applied wherever there are housing(s) and/or wall(s) and/or the like, for the purpose of opening up and/or closing off access at opening (s) therein.

As described above, in accordance with embodiment(s) of the present invention, disengagement of engagement produced by engaging means occurs due to the fact that actuation of disengaging means causes disengaging means to be displaced, causing access-controlling body or bodies to move away from engaging means and in direction(s) tending to cause disengagement of engagement produced by engaging means or causing engaging means to move away from access-controlling body or bodies and in direction(s) tending to cause disengagement of engagement produced by engaging means. Accordingly, access-controlling body or bodies may be extricated merely by actuating disengaging means, making for good ease of operations. Furthermore, method(s) in which access-controlling body or bodies is/are moved in parallel fashion may, for example, be employed as method (s) for deploying and/or removing access-controlling body or bodies, permitting adequate access over the entirety or entireties of opening(s) of apparatus main body or bodies. Furthermore, as engaging means, it is possible to employ simple constitutions which do not contained movable member(s) and in which projection(s) engage with projection(s), male portion(s) engage with female portion(s), and/or the like. As a result, it is easy to provide engaging means with adequate strength and it is possible to maintain satisfactory accuracy of positioning of access-controlling body or bodies by engaging means. Furthermore, it is possible to achieve reductions in engaging means design time and cost.

Furthermore, disengaging lever(s) may act as mechanical lever(s), with disengagement of engagement produced by engaging means occurring due to the fact that actuation of actuation region(s) of disengaging lever(s) causes action region(s) of disengaging lever(s) to be displaced. At such time, because actuation region(s) of disengaging lever(s) may receive actuation force(s) in direction(s) of deployment and/or removal of access-controlling body or bodies, it is possible for actuation capable of causing opening up of access at access-controlling body or bodies to commence simultaneous with disengagement of engagement produced by engaging means. This being the case, ease of operations in connection with opening up of access at access-controlling body or bodies may be improved greatly.

Furthermore, because action region(s) of disengaging lever(s) may be provided with rotatable roller(s), it is possible to reduce friction between action region(s) and portion(s) coming in contact with action region(s) during displacement of action region(s) of disengaging lever(s), reducing actuation force(s) at actuation region(s) of disengaging lever(s) and improving ease of operation of disengaging lever(s). Furthermore, if rolling of roller(s) at action region(s) of disengaging lever(s) is maintained when disengaging lever(s) is/are actuated during closing off of access at access-controlling body or bodies, this will make it possible to cause engagement produced by engaging means to be established in smooth fashion, to quickly deploy access-controlling body or bodies at opening(s) of apparatus main body or bodies, to achieve reduction in impact occurring at time(s) of deployment, and to improve accuracy of positioning of access-controlling body or bodies relative to opening(s) in apparatus main body or bodies.

What is claimed is:

1. An access-controlling mechanism comprising:

one or more apparatus main bodies;

one or more access-controlling bodies removably deployed at one or more openings of at least one of the apparatus main body or bodies;

one or more engaging means causing at least one of the access-controlling body or bodies deployed at at least one of the opening or openings of at least one of the apparatus main body or bodies to engage with at least one of the apparatus main body or bodies; and one or more disengaging means provided at at least one of the access-controlling body or bodies and disengaging engagement produced by at least one of the engaging means;

at least one of the disengaging means being such that disengagement of engagement produced by at least one of the engaging means occurs due to the fact that actuation of at least one of the disengaging means causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

2. An access-controlling mechanism according to claim 1 wherein:

at least one of the apparatus main body or bodies is at least one image forming apparatus main body;

at least one of the access-controlling body or bodies being removably deployed at at least one of the opening or openings of at least one of the image forming apparatus main body or bodies.

3. An access-controlling mechanism according to claim 1 wherein:

at least one of the access-controlling body or bodies is supported by one or more guide members so as to permit movement with respect to at least one of the apparatus main body or bodies.

4. An access-controlling mechanism according to claim 1 wherein:

at least one of the first direction or directions tending to cause disengagement of engagement produced by at least one of the engaging means is at least one approximately vertically upward direction or at least one approximately vertically downward direction; and at least one of the second direction or directions tending to cause disengagement of engagement produced by at least one of the engaging means is at least one approximately vertically upward direction or at least one approximately vertically downward direction.

5. An access-controlling mechanism according to claim 1 wherein:

at least one of the disengaging means is at least one disengaging lever comprising one or more actuation regions, one or more pivot regions, and one or more action regions; and disengagement of engagement produced by at least one of the engaging means occurs due to the fact that at least one of the actuation region or regions of at least one of the disengaging lever or levers receives one or more actuation forces, at least one of the action region or regions of at least one of the disengaging lever or levers is displaced, and at least one of the action region or regions of at least one of the disengaging lever or levers causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

6. An access-controlling mechanism according to claim 5 wherein:

at least one of the action region or regions of at least one of the disengaging lever or levers causes at least one of the access-controlling body or bodies to move away from at least one of the engaging means and in one or more first directions tending to cause disengagement of engagement produced by at least one of the engaging means, or causes at least one of the engaging means to move away from at least one of the access-controlling body or bodies and in one or more second directions tending to cause disengagement of engagement produced by at least one of the engaging means, in at least one vicinity of at least one imaginary vertical line depending from at least one center of gravity of at least one of the access-controlling body or bodies.

7. An access-controlling mechanism according to claim 5 wherein:

at least one of the action region or regions of at least one of the disengaging lever or levers causes at least one of the access-controlling body or bodies to move away from at least one of the engaging means and in one or more first directions tending to cause disengagement of engagement produced by at least one of the engaging means, or causes at least one of the engaging means to move away from at least one of the access-controlling body or bodies and in one or more second directions tending to cause disengagement of engagement produced by at least one of the engaging means, in at least one vicinity of at least one location where at least one of the access-controlling body or bodies is engaged by at least one of the engaging means.

8. An access-controlling mechanism according to claim 5 further comprising:

one or more disengaging-lever restoring-force-imparting means imparting at least one of the actuation region or regions of at least one of the disengaging lever or levers with at least one restoring force opposite in direction to at least one actuation direction.

9. An access-controlling mechanism according to claim 5 wherein:

at least one location where engagement by at least one of the engaging means occurs and at least one location of at least one of the action region or regions of at least one of the disengaging lever or levers differ in at least one direction perpendicular to at least one direction of deployment and/or removal of at least one of the access-controlling body or bodies.

10. An access-controlling mechanism according to claim 5 wherein:

at least one of the action region or regions of at least one of the disengaging lever or levers is in at least one vicinity of at least one pivot region of at least one of the disengaging lever or levers.

11. An access-controlling mechanism according to claim 5 wherein:

at least one of the action region or regions of at least one of the disengaging lever or levers is in at least one location distant from at least one pivot region of at least one of the disengaging lever or levers.

12. An access-controlling mechanism according to claim 5 wherein:

at least one of the action region or regions of at least one of the disengaging lever or levers is provided with one or more rotatable rollers.

13. An access-controlling mechanism according to claim 12 wherein:

at least one of the roller or rollers is at least partially cylindrical and/or spherical in shape.

14. An access-controlling mechanism according to claim 12 wherein:

at least one diameter of at least one of the roller or rollers is approximately equal to or is slightly greater than at least one height of at least one of the engaging means.

15. An access-controlling mechanism according to claim 1 wherein:

at least one of the disengaging means is such that at least one of the access-controlling body or bodies is displaced away from at least one of the apparatus main body or bodies simultaneously with respect to disengagement of engagement produced by at least one of the engaging means occurring due to the fact that actuation of at least one of the disengaging means causes at least one of the access-controlling body or bodies to move away from at least one of the engaging means and in one or more first directions tending to cause disengagement of engagement produced by at least one of the engaging means.

16. An access-controlling mechanism according to claim 1 further comprising:

one or more access-controlling-body restoring-force-imparting means imparting at least one of the access-controlling body or bodies with at least one restoring force in at least one deployment direction or in at least one removal direction.

17. An access-controlling mechanism according to claim 1 wherein at least one of the engaging means has:

at least one stepped surface for stopping at least one of the access-controlling body or bodies in at least one direction of deployment and/or removal of at least one of the access-controlling body or bodies; and at least one sloped surface for surmounting at least one of the stepped surface or surfaces.

18. An access-controlling mechanism comprising:

one or more apparatus main bodies;

one or more access-controlling bodies removably deployed at one or more openings of at least one of the apparatus main body or bodies;

one or more engaging means causing at least one of the access-controlling body or bodies deployed at at least one of the opening or openings of at least one of the apparatus main body or bodies to engage with at least one of the apparatus main body or bodies; and one or more disengaging levers provided at at least one of the access-controlling body or bodies and disengaging engagement produced by at least one of the engaging means;

wherein at least one of the disengaging lever or levers comprises one or more actuation regions, one or more pivot regions, and one or more action regions and is such that disengagement of engagement produced by at least one of the engaging means occurs due to the fact that at least one of the actuation region or regions of at least one of the disengaging lever or levers receives one or more actuation forces, at least one of the action region or regions of at least one of the disengaging lever or levers is displaced, and at least one of the action region or regions of at least one of the disengaging lever or levers causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

19. An image forming apparatus comprising:

one or more image forming apparatus main bodies;

one or more access-controlling bodies removably deployed at one or more openings of at least one of the image forming apparatus main body or bodies;

one or more engaging means causing at least one of the access-controlling body or bodies deployed at at least one of the opening or openings of at least one of the image forming apparatus main body or bodies to engage with at least one of the image forming apparatus main body or bodies; and one or more disengaging means provided at at least one of the access-controlling body or bodies and disengaging engagement produced by at least one of the engaging means;

at least one of the disengaging means being such that disengagement of engagement produced by at least one of the engaging means occurs due to the fact that actuation of at least one of the disengaging means causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

20. An image forming apparatus comprising:

one or more image forming apparatus main bodies;

one or more access-controlling bodies removably deployed at one or more openings of at least one of the image forming apparatus main body or bodies;

one or more engaging means causing at least one of the access-controlling body or bodies deployed at at least one of the opening or openings of at least one of the image forming apparatus main body or bodies to engage with at least one of the image forming apparatus main body or bodies; and one or more disengaging levers provided at at least one of the access-controlling body or bodies and disengaging engagement produced by at least one of the engaging means;

wherein at least one of the disengaging lever or levers comprises one or more actuation regions, one or more pivot regions, and one or more action regions and is such that disengagement of engagement produced by at least one of the engaging means occurs due to the fact that at least one of the actuation region or regions of at least one of the disengaging lever or levers receives one or more actuation forces, at least one of the action region or regions of at least one of the disengaging lever or levers is displaced, and at least one of the action region or regions of at least one of the disengaging lever or levers causes at least one of the access-controlling body or bodies to move away from at least one of the engaging means and in one or more first directions tending to cause disengagement of engagement produced by at least one of the engaging means or causes at least one of the engaging means to move away from at least one of the access-controlling body or bodies and in one or more second directions tending to cause disengagement of engagement produced by at least one of the engaging means.

* * * * *